US008323588B2

(12) United States Patent
Hoyer et al.

(10) Patent No.: US 8,323,588 B2
(45) Date of Patent: Dec. 4, 2012

(54) SAMPLE HANDLING DEVICE FOR AND METHODS OF HANDLING A SAMPLE

(75) Inventors: Olaf Hoyer, Dornburg (DE); Leander Dittmann, Jena (DE); Giso Gessner, Mohlsdorf (DE); Andreas Vester, Jena (DE)

(73) Assignee: Quantifoil Instruments GmbH, Jena (DE)

( * ) Notice: Subject to any disclaimer, the term of this patent is extended or adjusted under 35 U.S.C. 154(b) by 308 days.

(21) Appl. No.: 12/598,760

(22) PCT Filed: May 5, 2008

(86) PCT No.: PCT/EP2008/055510

§ 371 (c)(1),
(2), (4) Date: May 10, 2010

(87) PCT Pub. No.: WO2008/135565

PCT Pub. Date: Nov. 13, 2008

(65) Prior Publication Data

US 2010/0218620 A1 Sep. 2, 2010

Related U.S. Application Data

(60) Provisional application No. 60/916,008, filed on May 4, 2007.

(30) Foreign Application Priority Data

May 4, 2007 (EP) ..... 07107585

(51) Int. Cl.
*B01L 9/00* (2006.01)

(52) U.S. Cl. ..... 422/561

(58) Field of Classification Search ..... 422/561
See application file for complete search history.

(56) References Cited

U.S. PATENT DOCUMENTS

| | | | | |
|---|---|---|---|---|
| 3,944,188 | A | | 3/1976 | Parker et al. |
| 4,950,608 | A | | 8/1990 | Kishimoto |
| 5,229,580 | A | * | 7/1993 | Chioniere ..... 219/521 |
| 5,372,425 | A | | 12/1994 | Tannenbaum et al. |
| 5,455,175 | A | | 10/1995 | Wittwer et al. |

(Continued)

FOREIGN PATENT DOCUMENTS

DE 1816710 6/1970

(Continued)

OTHER PUBLICATIONS

International Search Report dated Oct. 24, 2008, issued in International Application No. PCT/EP2008/055510.

*Primary Examiner* — Bobby Ramdhanie
(74) *Attorney, Agent, or Firm* — Knobbe Martens Olson & Bear LLP

(57) ABSTRACT

A sample handling device (100) for handling a sample, the sample handling device (100) comprising a drive shaft (101) being drivable by a drive unit (102), a base plate (103) mounted to follow a motion of the drive shaft (101) when being driven by the drive unit (102), wherein the base plate (103) is configured to receive a sample carrier block (104) mountable to follow a motion of the base plate (103), and a compensation weight (105, 106) mounted asymmetrically on the drive shaft (101) in a manner to at least partially compensate an unbalanced mass of the sample handling device (100) during the motion.

31 Claims, 11 Drawing Sheets

U.S. PATENT DOCUMENTS

| | | | | | |
|---|---|---|---|---|---|
| 5,552,580 | A | | 9/1996 | Pfost et al. | |
| 5,569,357 | A | * | 10/1996 | Kuhn et al. | 159/16.1 |
| 6,015,534 | A | * | 1/2000 | Atwood | 422/550 |
| 6,074,610 | A | | 6/2000 | Huang et al. | |
| 6,190,032 | B1 | | 2/2001 | Choda | |

FOREIGN PATENT DOCUMENTS

| | | |
|---|---|---|
| DE | 29520997 | 9/1996 |
| DE | 19814013 | 7/1999 |
| EP | 0810030 | 12/1997 |
| EP | 0836884 | 4/1998 |
| GB | 2402090 | 12/2004 |
| JP | 2002001085 | 1/2002 |

* cited by examiner

SAMPLE HANDLING DEVICE FOR AND METHODS OF HANDLING A SAMPLE

RELATED APPLICATIONS

This application is a U.S. National Phase of International Application No. PCT/EP2008/055510, filed May 5, 2008, designating the U.S. and published on Nov. 13, 2008 as WO 2008/135565, which claims priority to European Patent Application No. 07107585.7, filed May 4, 2007 and of U.S. Patent Application No. 60/916,008, filed May 4, 2007. The content of these applications is incorporated herein by reference in its entirety.

This application claims the benefit of the filing date of European Patent Application No. 07107585.7 filed May 4, 2007 and of U.S. Provisional Patent Application No. 60/916,008 filed May 4, 2007, the disclosure of which is hereby incorporated herein by reference.

FIELD OF THE INVENTION

The invention relates to sample handling devices for handling a sample. The invention further relates to methods of handling a sample.

BACKGROUND OF THE INVENTION

Biochemical analysis systems for supplying, handling, and analyzing samples are important in the field of life science.

U.S. Pat. No. 4,950,608 discloses a temperature regulating container with a heater and a metal block in which test tubes with test samples are therein inserted and kept isothermally. Such a temperature regulating container provides a plurality of heat pipes embedded in the metal block and extended to the heater section located at bottom of the metal block uniformally maintain the temperature in the metal block. Heat tubes are further extended downwardly to a cooling chamber provided at the bottom of heater such that when a cooling medium, water or air flows in the cooling chamber, the metal block is cooled respondingly provide accurate cooling of test samples in test tubes according to a desired program.

DE 29520997 discloses a bearing for a lab device such as a lab shaker, in which a platform held by a bearing is moved by a drive unit in an x-direction and/or in a y-direction. The platform can be a table on which supports for reaction tubes are formed.

However, operation of such devices may be inconvenient for a user.

U.S. Pat. No. 6,190,032 discloses a shaking machine which contains a drive shaft having at an upper end thereof an eccentric shaft portion formed with a predetermined off-center value, a frame supporting the drive shaft via a bearing, and a shaking table provided on a lower surface thereof with a bearing in which the eccentric shaft portion is fitted and allows the shaking table to make a circular orbital revolving movement with the rotation of the drive shaft. The frame and the shaking table are connected to each other by an integral rotation regulating coupling for regulating the shaking table not to rotate integrally with the drive shaft, and the drive shaft penetrates the integral rotation regulating coupling.

U.S. Pat. No. 5,552,580 discloses a heated cover for a receptacle containing a vaporizable substance. The cover is heated to a temperature above the temperature of the substance so as to prevent condensation of vapor evaporated from the substance. A device for placing and removing the cover with respect to the receptacle is designed in connection with a temperature-controlled heating/cooling plate which controls the temperature of the contents of the receptacle.

EP 0,810,030 discloses a thermocycler apparatus for performing polymerase chain reaction (PCR) comprising a heating block and heated cover in which sample tubes are retained, heated and cooled as required. The heating of the upper portions and caps of sample tubes in use prevents condensation inside the tube caps thereby eliminating the need for a layer of oil floating on the surface of the sample liquid.

EP 0,836,884 discloses a system to apply a heat reaction to liquids which has at least one vessel, with at least one inner fluid-tight closure. At least one outer closure can give a pressure seal to the vessels. Also disclosed is an operation to carry the liquid through a pipette unit, which can be given inner and outer seals. The outer seals are removed from the vessel(s), and the pipette is inserted through the inner seal(s). The liquid is extracted from the vessel(s) into the pipette unit, or a liquid is discharged from the pipette system into the vessel(s).

JP 2002001085 discloses that, to smoothly shake a shaking table by a simple structure, an annular moving-side magnet is provided having a plurality of different magnetic poles arranged at the same distances and fixed around the peripheries of bearings installed beneath the shaking table fitted into an eccentric shaft part. An annular fixed-side magnet is provided which has an inner periphery with such a size as not to contact the outer periphery of the moving-side magnet when the moving-side magnet is rotating and which has magnetic poles in the same number with that of the moving-side magnet, the magnetic poles being arranged at the same distances and so that different magnetic poles are facing each other.

OBJECT AND SUMMARY OF THE INVENTION

It is an object of the invention to enable an efficient handling of a sample.

In order to achieve the object defined above, sample handling devices for handling a sample, and methods of handling a sample according to the independent claims are provided.

According to an exemplary embodiment of the invention, a sample handling device for handling a sample is provided, the sample handling device comprising a drive shaft being drivable by a drive unit (such as an electromotor), a base plate mounted to follow a motion (such as a rotation, particularly an eccentric rotation) of the drive shaft when being driven by the drive unit, wherein the base plate is configured to receive a sample carrier block mountable to follow a motion (such as an orbital motion or any other motion resulting in a shaking of a sample) of the base plate, and a compensation weight mounted (for instance asymmetrically) on the drive shaft (for instance to provide an inhomogeneous weight distribution around a circumference of the drive shaft) in a manner to at least partially compensate an unbalanced mass of the sample handling device during the motion.

According to another exemplary embodiment of the invention, a method of handling a sample is provided, the method comprising mounting a sample on a sample carrier block of a sample handling device, mounting the sample carrier block on a base plate of the sample handling device, wherein the base plate is mounted to follow a motion of a drive shaft being drivable by a drive unit of the sample handling device, driving the drive shaft by the drive unit (for instance to set the drive unit in motion), and at least partially compensating an unbalanced mass of the sample handling device during the motion by a compensation weight mounted (for instance asymmetrically) on the drive shaft.

According to still another exemplary embodiment of the invention, a sample handling device for handling a sample is provided, the sample handling device comprising a (for instance movably mountable (for instance in a manner to perform an orbital motion or any other motion resulting in a shaking of a sample) or removably/detachably mountable) sample carrier block, a plurality of sample reception units arranged in the sample carrier block and each adapted for receiving a respective sample container, and a sample temperature manipulation unit (such as a heater and/or a cooler) integrated in (for instance located within) the sample carrier block and adapted for manipulating (for instance adjusting) a temperature of each of the plurality of sample reception units, wherein the sample temperature manipulation unit is arranged symmetrically, particularly in a thermodynamical sense, with respect to at least a part (particularly with all) of the plurality of sample reception units.

According to yet another exemplary embodiment of the invention, a method of handling a sample is provided, the method comprising mounting a sample carrier block (for instance mountable in a movable manner (for instance in a manner to perform an orbital motion or any other motion resulting in a shaking of a sample) or in a removable/detachable manner), inserting a plurality of sample containers in a plurality of sample reception units arranged in the sample carrier block, and manipulating a temperature of each of the plurality of sample reception units by a sample temperature manipulation unit integrated in the sample carrier block and arranged symmetrically with respect to at least a part of the plurality of sample reception units.

The term "sample" may particularly denote any solid, liquid or gaseous substance, or a combination thereof. For instance, the sample may be a fluidic sample, particularly a biological substance. Such a substance may comprise proteins, polypeptides, nucleic acids, DNA strands, etc.

The term "sample handling device" may particularly denote any apparatus capable of treating a sample, particularly for performing mixing, heating, and/or shaking procedures.

The term "compensation weight" may particularly denote a physical mass which may be mounted on a drive shaft in a non-symmetric manner, that is to say with a non-rotationally symmetric weight distribution, to thereby intentionally compensate for vibration forces generated in parts of the sample handling device such as the base plate or the sample carrier block upon exertion of an orbital motion on the sample carrier block.

In the context of this application, the term "magnetic element" may particularly denote a permanent magnet or an electromagnet. A permanent magnet may be a ferromagnet such as iron, nickel or cobalt, NdFeB (neodymium-iron-boron), SmCo (samarium-cobalt). However, it is also possible to provide electromagnets which become magnetically activated only upon activation by an electric signal, thereby allowing to switch the direction of the magnetic force generated by such magnetic elements. Such magnetic elements may comprise north poles and south poles, wherein the orientation of such poles with respect to other magnetic elements define whether a magnetic force is repellent or attractive. When using electromagnets as magnetic elements instead of permanent magnets, it is possible that the characteristic curve of the electromagnet's activation current during a duty cycle may be controlled in accordance with a desired pattern or operation mode of the device. For example, this can be performed by adjusting an electric current value by a regulating or feedback loop. By taking this measure, it is possible to provide positioning and/or hold tasks in a flexible and user-definable manner (for instance to achieve a defined resting position of the sample handling device).

The term "arranged symmetrically" may particularly refer to a symmetric arrangement in a thermodynamic sense, i.e. regarding thermal equilibration characteristics. In other words, for exemplary applications, a thermodynamic symmetry may be of importance, i.e. very similar or identical thermal energy paths between a heat source/sink and the various sample containers. This can be obtained by a geometrical symmetry, but alternatively also by a geometrical asymmetry in combination with an ("inverse") asymmetry of the thermal equilibration properties of used materials, compensating the geometrical asymmetry to essentially obtain a thermodynamically symmetric system. However, for homogeneous and isotropic materials or media, a geometric homogeneity is sufficient to achieve a thermodynamic symmetry. Isotherms may be defined at positions at which different samples or sample holders are arranged.

According to an exemplary embodiment of the invention, a low vibration thermo-shaker may be provided in which a shaking or mixing motion may be applied to samples filled in sample carriers received in receptions of a sample carrier block. Simultaneously, it is possible to temper the samples in accordance with a predefined tempering sequence or protocol, to thereby assist biochemical experiments and mix components of the sample.

Thus, a thermo-shaker may be provided which may be designed for test tubes of different volumina, such as 1.5 ml, 0.5 ml and 0.2 ml. Other volumina such as 2.0 ml are possible as well. It is possible to provide the device with a microtiter plate, an array tube (for instance as provided by Clondiag Chip Technologies), a multiple sample stripe (for instance an 8 sample stripe), etc. Any desired formats of lab devices (particularly in a volume range from microliters to millilitres) may be used in combination with devices according to exemplary embodiments. Mixing up to 2.500 or even 6000 rounds per minute (and more) may be possible with a constant orbit of, for instance, 3 mm.

Embodiments of the invention may be used for a defined and reproducible handling (for instance mixing) of samples in sample holder containers. In order to achieve this, parameters being relevant for such a mixing procedure may be controlled or fixedly defined according to an exemplary embodiment. Such parameters may include, inter alia, rotational frequency, radius of orbital, device geometry or weight, sample volume, viscosity of sample medium, surface properties of an inner surface of the sample containers. Such parameters may be correlated. For example, a small fluid volume may result in a large ratio between surface and volume. Thus, a ratio between surface forces and inertia forces may be large. For a motion, these forces have to be overcome by larger external forces or accelerations. A larger acceleration may require a larger rotational speed or orbital radius, wherein the frame conditions of the container geometry are to be taken into account (turbulent or laminar flow conditions, generation of turbulence or vortex, etc.). The active control of the rotational speed is an example for a parameter which may be controlled when taken alone or particularly in combination with one or more other parameters.

The thermo-shaker may allow for a heating of the sample in a temperature range between room temperature and 100° C. A digital control with an accuracy of 1° C. and less may be possible. The heat-up time may be short, for instance 5 minutes from room temperature to 95° C. Moreover, a short cool-down time of for instance 8 minutes from 95° C. to room temperature may be made possible. Heating a cover of such an apparatus may prevent condensation in the test tubes.

Furthermore, the compact design of embodiments of the invention may save valuable bench top space.

Thus, a miniature thermo-shaker may be provided allowing for a high productivity and an ease of use. Compact designed, such an orbital thermo-shaker may allow to perform standard runs with a minimum of adjustments, and may offer outstanding performance to handle a wide range of applications across pharmaceutical, biotechnology, and academic research.

With a housing to safe, reliable and durable technology, embodiments of the invention allow to fit the standards of larger models into a very small space. A corresponding low size may allow for a fast heating and cooling.

Adapters and tubes may be inserted and removed with low effort. It is possible to choose between different adapters, for instance 0.2 ml PCR tubes, 0.5 ml tubes, 1.5 ml tubes, or 2.0 ml tubes. A display may simplify viewing of parameters. Setting parameters may also be performed in a fast and simple manner by a user interface. An apparatus according to an exemplary embodiment of the invention may offer user-friendly features including magnetic clamp mechanisms, easily comprehensible display for intuitive operation, and a separate short mix key for immediate runs.

Embodiments of the invention may be essentially maintenance-free and may accelerate different tubes to a speed of up to 2.500 or even 6000 rounds per minute with a simultaneous temperature control up to 100° C. or more. In contrast to conventional thermo-shakers, a very fast cooling and heating is possible due to the small size. Such a fast heat up/cool down may offer significant time savings increasing productivity. Thus, a small size, a high stability, and a fast tempering—even at maximum mixing frequency—may make the apparatus reliable for short reaction times and efficient lab routines.

Over a wide range of shaking frequencies, such as 200 rounds per minute or less up to 2.500 or even 6000 rounds per minute and more, a combination of shaking and tempering may be obtained. Even at such high frequencies, the orbital motion of a sample carrier block carrying the samples may be prevented from generating disturbing vibrations, by providing one or more sufficiently heavy compensation masses for compensating or equilibrating vibrations.

According to an exemplary embodiment of the invention, a life science apparatus may be equipped with sample shaking and vibration compensation features, particularly by providing eccentrically aligned compensation weights which may be provided on opposite sides of a rotation axis, for instance on a shaft.

In addition to such a low vibration feature, it is also possible to homogeneously temper samples provided in sample holders of a sample carrier block of a sample handling apparatus according to an exemplary embodiment of the invention. For this purpose, the sample carrier block may be provided as a rotationally symmetrical cylinder which may be simply put in the device before or after being loaded with the samples and can be held by a magnetic clamp mechanism. As a heating source, an ohmic heating element (for instance powered with a voltage of 24 V) may be provided centrally in a recess formed in the sample carrier block. By a constant distance between such a heating source and the sample holders to be heated, a uniform heating with an identical time dependence can be ensured in a part of or in all of the sample holders. Additionally or alternatively to an ohmic heating, it is possible to provide for a hot air heating, wherein the hot air may be directed to stream between/around individual sample containers. For example, the sample containers may be accommodated in an open support element so as to be properly exposed to a hot air stream.

Alternatively, it is possible to provide a plurality of concentrically arranged (virtual) rings of sample holders, so that different circles at which the sample holders are positioned can be operated simultaneously, allowing to perform a plurality of groupwise experiments at the same time. By taking this measure, the throughput may be further increased.

According to an exemplary embodiment of the invention, a heating cartridge or any other heating element can simply be inserted centrally in a recess of the sample carrier block, thereby allowing for a homogeneous temperature distribution within the plurality of sample reception units. An improved heat transfer may be made possible by aligning the heating source nearly by and symmetrically with regard to a plurality of sample holders. This may allow to heat up a liquid sample in a faster manner due to an improved heat transfer, as compared to a non-symmetrical configuration. By positioning the heating source/sink as a close as possible at the containers to be heated, short heat paths and thus a short heating time are obtainable, while simultaneously achieving essentially the same temperature in all sample containers. In other words, the sample containers may be positioned along an isotherm trajectory (defined by the heating source/sink and the environment).

Cooling can be effected by the same heater and/or cooler element (for instance using a Peltier element), or may also be effected by a ventilator such as a turbo fan which can generate an air stream which may be blown radially onto the sample carrier block so that efficient cooling may be obtained by heat convection. In other words, the air streaming around the sample carrier block may result in such an effect.

Additionally, a further heating element may be integrated in a cover of the apparatus and may be provided above the sample carrier block. For instance, such a heater may heat the cover to a temperature slightly above the temperature of the block, for instance five degrees Celsius above. This may prevent condensation of sample material at an inner upper surface of the sample containers which may happen conventionally. The cover may be fastened magnetically to the casing of the sample handling device and may be detachable. A magnetic material or an electric wire can be used for supplying an electric current to the heater in the cover element.

An upper compensation weight may compensate effects of the sample holding block oscillating on an orbital trajectory which may be advantageous for shaking Since such a compensation can only be performed partially (at least when the compensation weight is located out of the block) with a single compensation weight, a second compensation weight may be provided which may correct a remaining unbalance at least partially.

At the compensation weight or on at least one of a plurality of compensation weights, a blade or wing-like structure may be attached so that the moving compensation weight may be simultaneously serve as a ventilator. Therefore, adjacent elements such as an electric circuitry driving the sample handling device may be efficiently cooled without additional effort.

Moreover, magnetic effects may be used as contactless guides for guiding a moving base plate on which the sample carrier block may be fastened. Such magnets may be bar magnets or may be annular magnets or may be disk-shaped magnets. Thus, a magnetic guiding mechanism may be provided, which may be further refined by providing a ball bearing system or bush bearing system for bearing a base plate for the thermo-block, so that a sandwich configuration between a base plate and surrounding guiding plates may be obtained. With such a configuration, a two-dimensional motion is enabled, whereas a vertical motion of the base plate may be suppressed, further improving the mechanical stability of the system.

Next, further exemplary embodiments of the sample handling devices will be explained. However, these embodiments also apply to the methods.

The drive shaft may be an eccentric drive shaft. The eccenter may realize an orbital momentum (or an orbital angular momentum) of the center of gravity of the moved mass (being the origin of the imbalance), in contrast to a pure spin. This center of gravity of the mass, which does not have an intrinsic spin, can move along a circular trajectory, but also along an eccentric, elliptic trajectory. This may allow to generate a mixing motion, in contrast to a pure rotating motion.

The sample handling device may comprise a guide structure mounted to remain spatially fixed when the base plate is moving, wherein the base plate is mounted at the guide structure to enable the base plate to move within a plane and to disable the base plate to move out of the plane. The guide structure may comprise one, two or more elements (for instance two guide plates, or one guide plate and a clamping member).

More particularly, the sample handling device may comprise a first guide plate and a second guide plate. The first guide plate may be an upper guide plate and the second guide plate may be a lower guide plate in a vertical direction of the sample handling device defined by an extension of the vertically aligned drive shaft. The first guide plate and the second guide plate may be mounted to remain spatially fixed when the base plate is moving. Thus, the first and the second guide plates are adapted to be static in the lab system. The base plate may be mounted between the first guide plate and the second guide plate to enable the base plate to move within a (horizontal) plane and to disable the base plate to move out of the plane. Therefore, a two-dimensional motion of the base plate is possible in a horizontal plane, whereas a vertical motion may be efficiently suppressed or even made impossible.

A ball bearing may be provided and adapted for bearing the base plate. Such a ball bearing may be provided on a surface of the first guide plate and/or on a surface of the second guide plate. In other words, the base plate on which the sample carrier block may be mounted may be guided on an upper and/or lower surface by the ball bearing allowing for a low friction motion within this two-dimensional plane.

As an alternative to a ball bearing, it is also possible to use a bush bearing or a slide bearing in which the base plate slides on the bush bearing to be thereby guided along a sliding surface with a low frictional.

Furthermore, the sample handling device may comprise a contactless magnetic field guide structure (defining the motion shape).

This may be realized by at least one first magnetic element arranged on the base plate. At least one second magnetic element may be provided and arranged on the first guide plate and/or on the second guide plate. The at least one first magnetic element and the at least one second magnetic element may be configured to cooperate in a manner to convert an eccentric motion of the drive shaft into an orbital motion of the base plate. The described magnetic guiding system for guiding the base plate within the guide plates may be highly advantageous, since this may allow for a contactless regulation of the motion system, involving low friction and reducing material contact.

The at least one first magnetic element and the at least one second magnetic element may be configured to generate a mutually repellent and/or attractive magnetic force. Therefore, a stable equilibration state of the base plate within the guide plates may be ensured so that the base plate may be automatically maintained in a minimum of a potential. The magnetic forces may be designed such that the weight of the base plate (and mounted parts) may be at least partially compensated by the action of the magnetic forces. One possible realisation is to arrange the magnets in the guide plates and in the base plate in an attractive manner and at such a vertical distance from each other that the sum of the gravitational force and the magnetic force of the lower guide plate equals the magnetic force of the upper guide plate so as to obtain a vanishing (or a basically vanishing) vertical force acting on the base plate. This may keep friction low and may provide for a smoothly running device.

The compensation weight may be mounted to at least partially compensate a static and/or an unbalanced mass of the sample handling device during the motion.

By compensating such static and dynamic unbalances, the vibration may become lower and the lifetime of the apparatus may be increased.

The compensation weight may also be mounted to at least partially compensate torque during an acceleration. Therefore, also when accelerating or slowing down the orbital motion of the sample carrier plate, such a compensation may be performed. This may ensure a safe operation of the device and may suppress vibrations during speeding up and slowing down.

The compensation weight may comprise a first weight element arranged at a first position of the drive shaft and may comprise a second weight element arranged at a second position of the drive shaft, wherein the first position is closer to the base plate than the second position. The compensation weight (s) may be designed appropriately, wherein a product of mass center and distance may define its compensation impact. The first weight element and the second weight element may be arranged on opposing sides of the drive shaft. Therefore, the contributions or balancing effect of the two weight elements may supplement each other, so that an asymmetric orientation of the weight elements around the rotation axis may be advantageous.

The compensation weight may comprise at least one blade element or wing element adapted for providing ventilation when moving the compensation weight. Therefore, the motion of the compensation weight required for reducing the oscillations or vibrations may also be used to generate an air stream which can be used to cool surrounding members by convection. By taking this measure, the air may be redirected to an element to be cooled, such as an electronic circuitry or the sample carrier block.

The sample carrier block may be mounted on the base plate. The sample carrier block may comprise a plurality of sample reception units such as recesses dimensioned and shaped in the sample carrier block to receive a respective sample container. Such a sample container may be a plastic tube of a volume of several millilitres or microliters, for instance.

The sample handling device may comprise a sample temperature manipulation unit integrated in the sample carrier block and adapted for manipulating a temperature of each of the plurality of sample reception units. Such a temperature manipulation unit may be a heater or a cooler and may be provided in a recess formed in the sample carrier block to thereby provide an efficient cooling. The heat flow from a heating or a cooling element of the temperature manipulation unit and the components to be cooled may be such that an efficient heat transfer is made possible.

The sample temperature manipulation unit (a heat source or sink) may be arranged symmetrically with respect to at least a part of the plurality of sample reception units. For example, the sample reception units may be provided on a rotationally symmetric trajectory, for instance a circle on a circular surface of the sample carrier block. The sample temperature manipulation unit may then be provided along a symmetry axis of the cylinder, buried within the cylinder. This may allow for a homogeneous propagation of heat from the temperature manipulation unit to each of the sample reception units.

The plurality of sample reception units may be arranged in the sample carrier block in a rotationally symmetrically manner. Examples of such a rotationally symmetric structures are circles, cylinder surfaces, spherical surfaces etc.

At least a part of the plurality of sample reception units may be arranged in the sample carrier block at the same distance from the sample temperature manipulation unit. By equidistantly spacing the sample reception units with regard to the temperature manipulation unit, a temperature profile generated by the temperature manipulation unit may be transferred in an identical manner to each of the sample reception units, thereby allowing to provide essentially identical experimental parameters in each of the sample reception units.

The sample carrier block may comprise a central recess for receiving the sample temperature manipulation unit, wherein the central recess may have the same distance from at least a part of the plurality of the reception units. More particularly, the central recess may have the same distance from all of the sample reception units. This may further improve the homogeneity of the temperature sequence applied to each of the sample units.

The sample temperature manipulation unit may comprise at least one of the group consisting of a heater element and a cooling element. Such elements may be heating cartridges, ohmic heaters, heating foils, heating resistances, Peltier heaters or Peltier coolers. Such temperature manipulation units may be provided as capsule-like elements in a recess, for instance in a center of gravity, of the sample holding block.

The sample carrier block may be made of a thermally conductive material, such as a metal like aluminium or copper. This may promote the heat transfer along the sample carrier block, that is to say from the temperature manipulation unit to each of the samples.

The sample handling device may comprise at least one third magnetic element arranged on the base plate and may comprise at least one forth magnetic element arranged on the sample carrier block, wherein the at least one third magnetic element and the at least one forth magnetic element are configured to cooperate in a manner to fasten the sample carrier block at the base plate by an attracting magnetic force. Therefore, mounting and disassembling of the sample carrier block at the base plate may be made possible with very low effort, by simply attaching the sample carrier block onto the surface of the base plate. An attracting magnetic force will then keep the sample carrier block securely at a base plate, even when the system is moved. This may ensure a secure operation of the device and an ease of use for a user.

The sample handling device may comprise a ventilator adapted for generating a cooling fluid flow streaming around the sample carrier block. Such a cooling fluid flow may be an air stream, another gas stream or may also include a liquid stream, such as a stream of water. Using such a ventilator may allow to quickly cool down the system to properly follow a predefined or user-defined temperature protocol.

The sample carrier block may be cylindrical, allowing for a low vibration when the sample carrier block is brought in motion, and allowing for a symmetric configuration of the sample carriers with regard to a cooling or heating element.

A cover element may be provided for covering the sample carrier block. Such a cover element may comprise an additional heater element for heating an upper portion of the sample carrier block. This may prevent condensation of sample material within sample tubes inserted in the sample receptions of the sample carrier block, since the additional heater element may bring a top portion of the sample tubes to a slightly higher temperature as compared to the remaining portion of the sample, thereby preventing or inhibiting condensation at such a top surface.

At least one fifth magnetic element may be arranged on the cover element, and at least one sixth magnetic element may be arranged on a casing of the sample handling device. The at least one fifth magnetic element and the at least one sixth magnetic element may be configured to cooperate in a manner to fasten the cover element at the casing by an attracting magnetic force. Thus, the cover element may be magnetically fastenable to the casing.

The at least one fifth magnetic element may be configured to conduct an electric current between the cover element and the casing. Therefore, this magnetic element may simultaneously be used for supplying current or any signal to active elements within the cover element, such as the heater.

The sample handling device may be adapted for shaking a sample contained in a plurality of sample containers received in a plurality of recesses in the sample carrier block and for simultaneously manipulating a temperature of the sample. Thus, a thermo-shaker may be provided.

The sample handling device may comprise a support element adapted to at least partially accommodate the drive shaft and the drive unit (therein and/or thereon) and adapted in such a manner that the base plate is mountable on the support element. Such a support element may provide a sufficiently heavy or stable basis in which several components such as the drive unit may be received and which may serve simultaneously as a support for receiving the base plate, which, in turn, may then receive the sample carrier block on top thereof.

The support element may comprise one or more guide holes (formed in a surface portion of the support element), and the base plate may comprise one or more guide pins (formed in a surface portion of the base plate) which may be configured to correspond to the one or more guide holes so that the base plate is mountable on the support element by inserting each of the guide pins into a corresponding one of the guide holes. By the guide holes and the guide pins, a shape coding mechanism may be provided which may prevent the user from mounting the base plate in an incorrect manner on the support element. Such a shape coding feature may be particularly safe when a plurality of guide holes and corresponding guide pins are provided. A user therefore only has to position the base plate in such a manner that the guide pins extending from a lower side of the base plate are aligned with the corresponding guide holes. The user may then lower the base plate towards the support elements so that the guide pins engage into the guide holes.

Alternatively, it is possible to exchange the tasks of the guide holes and of the guide pins, i.e. to provide guide holes at the base plate and guide pins at the support element.

The support element may comprise a plurality of for instance circularly arranged guide holes, and the base plate may comprise a plurality of for instance circularly arranged guide pins configured to correspond to (or to be aligned with) the plurality of guide holes. It may be particularly advantageous that three guide holes and three guide pins are provided, because this may safely prevent any mechanically erroneous insertion of the base element into the support element. Apart from a simplification of the insertion procedure, the provision of guide holes and guide pins may have the further advantage that during the actual sample handling performance of the sample handling device, the base plate is securely maintained coupled to the support element so as to reduce the danger of undesired uplift of the base plate from the support element. Therefore, the provision of sufficiently long guide pins and correspondingly shaped guide holes may also improve safety. A lateral extension of the guide pins may be smaller (by more than manufacturing tolerances) than a lateral extension of the guide holes to thereby allow a mixing orbital motion with a definable shaking amplitude.

At least one seventh magnetic element may be arranged in an interior (for instance at a bottom surface) of each of the one or more guide holes, and one or more eighth magnetic elements may be provided on at least a part of the one or more guide pins (for instance at a bottom surface). By taking this measure, a correct positioning between base plate and support member may be guaranteed with further increased accuracy.

Particularly, the seventh magnetic element and the eighth magnetic element may be configured to attract one another. This may be achieved to secure the base element at the support member during motion of the device, thereby further improving safety of operation. Alternatively, a repulsive force may be generated between the seventh and the eighth magnetic elements to support a floating of the base element on the support element and thus a very low friction operation.

The seventh magnetic element(s) and/or the eighth magnetic element(s) may be configured as permanent magnets or as electromagnets, wherein in the latter case a flexible adjustment of the respective tasks of the magnetic elements may be adjusted.

The support element may comprise at least one first bearing hole. The base plate may comprise at least one second bearing hole configured to correspond to the at least one first bearing hole. The sample handling device may comprise at least one ball arranged partially within the at least one first bearing hole and partially within the at least one second bearing hole to thereby form a ball bearing between the support element and the base element. Such a ball bearing may allow for a low friction motion of the base element relative to the support element in the presence of a shaking operation. The bearing holes may be shaped with such a lateral dimension that the balls may freely move within them. On the other hand, a vertical extension of the bearing holes may be such that the base element floats on the ball bearing and has no direct physical contact with the support. This allows simultaneously to obtain both a reliable bearing and a low friction operation.

Particularly, the support element may comprise a plurality of, particularly three or five, circularly arranged first bearing holes. The base plate may comprise a plurality of, particularly three or five, circularly arranged second bearing holes configured to correspond to the plurality of first bearing holes. The sample handling device comprises a plurality of, particularly three or five, balls. When providing three balls, these three balls define three abutment points with the base plate, thereby defining a motion plane of the base plate, wherein this plane is defined by the three abutment points of the balls. Centers of gravities of the balls and/or centers of the (for instance cylindrical) bearing holes may be arranged along a circumference of a (virtual) circle.

Like the guide holes and the guide pins, the balls may have a lateral extension which is smaller than a maximum lateral extension of the bearing holes to thereby allow for a rotational or an orbital motion of the base plate relative to the support element with a maximum amplitude which is defined by this difference of lateral extensions.

The balls may be made of a material which provides both a low friction and low wear off to ensure a long lifetime of the device. Appropriate materials for the balls are plastic materials such as polyamide-imide (Torlon), polyamide or polyoxymethylene. Alternatively, a metallic material such as stainless steel or aluminium may be used for the balls. It is also possible to coat a ball (for instance made of a metal) with a suitable plastic coating such as a Teflon coating.

As an alternative to the ball bearing configuration, it is also possible to provide the bearing as a bush bearing or slide bearing. In such an embodiment, a coupling between base plate and support element is not defined by points but by a surface region.

It is also possible to provide at least one ninth magnetic element arranged in an interior of the at least one first bearing hole and to provide at least one tenth magnetic element in an interior of the at least one second bearing hole. By taking this measure, the bearing properties may be further refined by the application or superposition of a magnetic force.

More particularly, the ninth magnetic element and the tenth magnetic element may be configured to attract one another. By taking this measure, the maintenance of the base plate on the support member may be ensured, to prevent the danger of undesired lift off of the base element from the support member when large mixing forces are applied.

Alternatively, it is also possible to provide a repulsive force between the ninth and the tenth magnetic element to thereby further decrease the friction of the bearing.

The ninth magnetic element(s) and/or the tenth magnetic element(s) may be configured as permanent magnets or as electromagnets, wherein in the latter case a flexible adjustment of the respective tasks of the magnetic elements may be adjusted.

The sample handling device may comprise at least one centering plunger (or pin) which may be arranged in a movable (for instance slidable or shiftable or reciprocatable) manner within the support element, and being adapted to be moved to project out of the support element and to abut against a lower surface of the base plate to thereby drive back or restore the base plate to a central position or default position. Particularly in an embodiment in which the sample handling device is filled with a fluidic sample (and/or a fluidic sample is removed from the sample handling device) using a robot or the like, it may be very important that the sample handling device rests in a defined "zero" position after shaking For this purpose, when the shaking operation is to be stopped, a plunger may be driven upwardly out of the support element (for instance using an electric motor) to abut against a bottom surface of the base plate to exert a force onto the base plate, so that the base plate is forced towards a specific position defining this zero position or central position.

The at least one plunger (it is also possible to provide a plurality of, for instance three, plungers) may be adapted to be moved to project out of the support element upon switching off the drive unit. During operating the sample handling device, i.e. during mixing or the like, the plunger may remain retracted into the support element.

The at least one centering plunger may be conically shaped, for instance may have a conically tapering tip. With such a conical shape, it is possible that the centering plunger can be precisely positioned within a centering hole arranged within the lower surface of the base plate corresponding to the at least one centering plunger, so that the centering hole is engaged by the actuated centering plunger when moving in an upward direction to project out of the support element. This may further increase the accuracy of the operation to drive the sample handling device in the zero position.

For adjusting a zero position of the device, a drive motor may slow down. Then, a conical centering plunger may be raised by an electric drive to project out of an upper surface of the support element to be brought in engagement with a correspondingly shaped hole in the base plate. Then, the motor may be stopped. Such a zero position may be important for a capillary needle for filling fluids into this apparatus.

The base plate may have a rectangular shape, or an essentially rectangular shape. Such a geometry may be particularly appropriate when a rectangularly shaped microtiter plate shall be mounted on the base plate. Also the support element may have a rectangular shape (or at least an essentially rectangular shape) dimensioned to correspond to the essentially rectangularly shaped base plate. Thus, a lateral extension of support element and base plate may be essentially identical, allowing for a very compact construction.

The base plate may have a rectangular reception area adapted for receiving a rectangular sample carrier block (such as a microtiter plate). This accommodation area may have almost the same size of the surface of the base plate, so that an optimum use of the surface may be enabled.

The base plate may comprise one or a plurality of engagement members which may be arranged for instance in corners of the base plate and which may be adapted for engaging the rectangular sample carrier block for fastening purposes. For example, four engagement members may be provided at the four corners of the rectangular base plate. In these corners, flat springs, or other fastening elements may be provided to allow for a reliable fastening of the sample carrier block. Such engagement members may also include clamping or clicking or snap-in connection elements.

The sample handling device may have exactly one compensation weight element, particularly may have exactly one compensation weight element having a center of gravity being arranged at the same vertical level as the center of gravity of the cooperatively moving base member and sample carrier block. By basically adjusting the same vertical position of the center of gravity of the compensation weight and of the moving portions of the sample handling device, the provision of a single compensation weight may be sufficient which allows for a compact and lightweight construction.

The base plate may have a recess in a bearing surface (that is a lower surface in normal operation) opposing a sample surface portion (which may be an upper surface portion in normal operation) at which the sample carrier block is mountable. At least a part of the compensation weight may be received within the recess when the base plate is mounted on the support element. By taking this measure, it may become possible with a space-saving geometry to bring the vertical centers of gravities of the compensation weight and of the moving parts close together.

The sample carrier block may be a microtiter plate. More particularly the sample carrier block may be a microtiter plate having a plurality of wells arranged in a matrix-like manner. For instance, 24, 96, 384 or any other desired number of wells may be provided in such a microtiter plate allowing for high throughput applications of the sample handling device.

The sample carrier block may comprise a vortex member adapted to provide a vortex function to a user operating the sample handling device. Such a vortex member may include a recess in which a user may manually insert or press a sample container to provide for mixing or the like. Additionally or alternatively, such a vortex may be provided by an appropriate coating such as a coating with a rubber surface to keep the container in place when the vortex operation is performed.

Such a vortex function may denote a function for moving containers, typically larger tubes or capillaries. The vortex function may serve to resuspend sedimented material or to dissolve dissolvable substances by a strong and fast shaking For that purpose, it is possible that the user grips the sample container manually and presses the sample container with the lower tip towards the vortex provision. This pressing procedure may trigger or activate the vortex mechanism to move (for instance using an eccenter of 1 mm to 3 mm) shaking the lower end of the tube. Such a procedure may be continued for several seconds. It is for example possible to implement such a function using a rubber pin having a recess therein, in which the container may be pressed. Below such a mechanical coupling portion, a pressure sensor may be provided. As long as the pressure sensor senses the presence of a pressure generated by a user, the vortex mechanism will shake the container with a fixed amplitude and rotational speed. As soon as the pressure sensor does no more detect a pressure of more than a threshold value, the vortex mechanism may be stopped.

The sample handling device may comprise a sample temperature manipulation unit integrated in the base plate and adapted for manipulating a temperature of each of a plurality of sample reception units of the sample carrier block simultaneously. The sample temperature manipulation unit may serve for heating or cooling the sample carrier block. For example, it may be arranged to generate an isotherm in each of the plurality of sample reception units of the sample carrier block. Therefore, identical experimental conditions may be ensured in each of the sample containers. Alternatively, it may be possible to control the temperature in different sample containers to be different, for instance to allow for a user-defined temperature profile within the sample carrier block.

The sample temperature manipulation unit may be a heater which may be realized as an ohmic heater, a Peltier element or a hot air ventilation heater. Additionally or alternatively, the sample temperature manipulation unit may also comprise a cooling element. Such a cooling element may be realized as a Peltier element or as a cold air ventilation element.

Embodiments of the invention may have the advantage that even at high values of rotary speed, only the sample carrier block (such as a microtiter plate) vibrates, but not the entire sample handling device. It may be advantageous to dimension the shaker only slightly larger than the microtiter plate so as to be compatible with larger shaking apparatuses. The shaking operation may be limited to the xy plane (horizontally), wherein a motion along the vertical z-axis may be essentially zero. In an embodiment of a microtiter plate, a circular motion may also be present at a wall of a well, so that the shaking may be defined precisely and may be sufficiently gentle to be applicable also for sensitive molecules such as DNA. By providing an eccentric drive shaft, an orbital motion may be promoted. As a rule of thumb, the orbit may be the larger, the larger the filling volume of a sample container is. The smaller the filling volume, the higher should be the rotational motion. Embodiments of the invention may be capable to provide rotational motions of 3.000 to 6.000 rounds per minute.

According to an exemplary embodiment, the base plate may rest above the support element using three balls or spheres, thereby ensuring an accurate planar support. In an alternative embodiment, five balls or a support along a complete plane is provided. By combining such bearing features with a magnetic guiding mechanism, an accurate resting of the base plate on the spheres may be ensured. The magnets may contribute to a repeated centering of the system during the motion. Thus, an essentially contact-free and very accurate guiding may be made possible. According to an exemplary embodiment, a mass equilibration may be realized essentially within the shaking plane by a semi disk-shaped compensation weight.

By the combination of a magnetic guiding and a mass equilibration, a high performance shaking device may be obtained.

It is possible to provide the base plate substitutable so as to match the system with different sizes or number of wells in a desired reception plate. It is also possible to implement one or more further features within the base plate, such as a heating foil. Thus, a modular system with a high degree of flexibility may be obtained.

The aspects defined above and further aspects of the invention are apparent from the examples of embodiment to be described hereinafter and are explained with reference to these examples of embodiment.

BRIEF DESCRIPTION OF THE DRAWINGS

The invention will be described in more detail hereinafter with reference to examples of embodiment but to which the invention is not limited.

DESCRIPTION OF EMBODIMENTS

Figure 1:
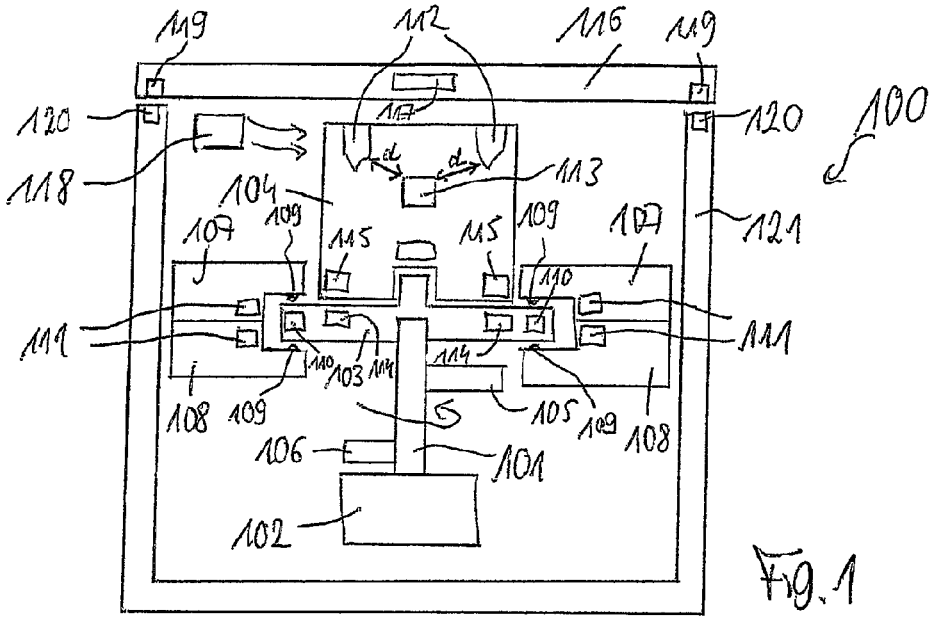
FIG. 1 is a schematic view of a sample handling device according to an exemplary embodiment of the invention.

The illustration in the drawing is schematically. In different drawings, similar or identical elements are provided with the same reference signs.

In the following, referring to FIG. 1, a sample handling device 100 for handling a biological sample according to an exemplary embodiment of the invention will be explained in detail.

A rotatable drive shaft 101 is drivable by a drive unit 102 such as an electromotor. A base plate 103 is mounted to follow a motion of the drive shaft 101 when being driven by the drive unit 102, wherein the base plate 103 is configured to receive a sample carrier block 104 mountable to follow a motion of the base plate 103. Compensation weights 105, 106 are mounted asymmetrically at different vertical heights on the drive shaft 101 in a manner to at least partially compensate an unbalanced mass of the sample handling device 100, more particularly of the sample carrier block 104, during the motion. The drive shaft 101 is an eccentric drive shaft.

Furthermore, a first guide plate 107 and a second guide plate 108 are provided. The first guide plate 107 and the second guide plate 108 are mounted to remain spatially fixed when the base plate 103 is moving along an orbital trajectory. The base plate 103 is mounted between the first guide plate 107 and the second guide plate 108 to enable the base plate 103 to move within a horizontal plane and to disable the base plate to move out of the horizontal plane.

Furthermore, a ball bearing 109 is provided for bearing the base plate 103. The ball bearing 109 is provided on a surface of the first guide plate 107 and on the surface of the second guide plate 108.

The sample handling device 100 further comprises a first magnetic element 110 arranged on the base plate 103. Furthermore, second magnetic elements 111 are arranged on the first guide plate 107 and on the second guide plate 108. The first magnetic element 110 and the second magnetic elements 111 are configured to cooperate in a manner to convert an eccentric motion of the drive shaft 101 into an orbital motion of the base plate 103. The first magnetic elements 110 and the second magnetic elements 111 are configured to generate a mutually repelling or attracting magnetic force, mechanically guiding the base plate 103 within the guide plate 107, 108.

Compensation weight units 105, 106 are mounted to compensate a static and a dynamic unbalanced mass of the sample handling device 100 during the rotation. More particularly, the compensation weights 105, 106 comprise a first weight element 105 arranged at an upper position of the drive shaft 101 and comprise a second weight element 106 arranged at a lower position of the drive shaft 101, wherein the upper position is closer to the base plate 103 than the lower position. More particularly, the first weight element 105 is located above the second weight element 106. The first weight element 105 is provided closer the sample carrier block 104 than the second weight element 106. The first weight element 105 and the second weight element 106 are arranged on opposing sides of the drive shaft 101.

The sample carrier block 104 is mountable on the base plate 103 to follow a motion of the base plate 103 and comprises a plurality of sample reception units 112 arranged in the sample carrier block 104, more particularly in an upper surface of the sample carrier block 104, and are adapted for receiving respective sample containers 150 such as a tube carrying 1 ml of a biological sample. FIG. 1 illustrates two such sample containers 150 containing a biological sample 151, one of the sample containers 150 having an opened cap, and the other one having a closed cap.

A sample temperature manipulation unit 113 is provided and integrated within an interior of the sample carrier block 104 and is adapted for manipulating a temperature of the plurality of sample reception units 112 and, in turn, of the sample 151 in a container 150 accommodated in one of the sample reception units 112. The sample temperature manipulation unit 113 is arranged symmetrically with respect to the plurality of sample reception units 112. As can be taken from FIG. 1, the plurality of sample reception units 112 are arranged in the sample carrier block 104 in a rotationally symmetrically manner. More particularly, the plurality of sample reception units 112 are arranged in the sample carrier block 104 at the same distance "d" from the sample temperature manipulation unit 113.

The sample carrier block 104 comprises exactly one central recess for receiving a sample temperature manipulation unit 113, wherein the central recess has the same distance "d" from all of the plurality of sample reception units 112. The sample manipulation unit 113 serves for heating and may be a heating cartridge. The sample carrier block 104 may be made of a thermally conductive material such as aluminium or copper.

A third magnetic element 114 is arranged on the base plate 103, and a forth magnetic element 115 is arranged on the sample carrier block 104. The third magnetic element 114 and the forth magnetic element 115 are configured to cooperate in a manner to fasten the sample carrier block 104 at the base plate 103 by an attracting magnetic force. Therefore, when the sample carrier block 104 is attached by a user to the base plate 103, the attractive magnetic forces may put the sample carrier block 104 correctly in place with regard to the base plate 103, so that attaching and detaching of the sample carrier block 104 with respect to the base plate 103 can be performed easily by a human operator.

A ventilator 118 is provided for generating a cooling air flow streaming around the sample carrier block 104. Such a circulation of a gas flow around the sample carrier block 104 may efficiently cool all of the sample tubes 150 inserted in the receptions 112 simultaneously.

A cover element 116 may be provided for covering the sample carrier block 104. The cover element 116 comprises a heater element 117 for heating an upper portion of the sample carrier block 104. Furthermore, a fifth magnetic element 117 is arranged on the cover element 116. A sixth magnetic element 120 is arranged on the casing 121 of the sample handling device 100. The fifth magnetic element 119 and the sixth magnetic element 120 are configured to cooperate in a manner to fasten the cover element 116 at the casing 121 by an attracting magnetic force. Therefore, a user may selectively open or close the cover element 116 to expose or cover an interior of the sample handling device 100. The cover element 116 may be pivotable and/or may be detachable by removing it completely from the sample handling device.

With the sample handling device 100, it is possible to shake a sample 151 contained in a plurality of sample containers 150 received in a plurality of recesses 112 in the sample carrier block 104 and for simultaneously manipulating a temperature of the sample 151.

Embodiments of the invention relate to mix and tempering devices for lab systems.

Such devices may be used in a medical, chemical and biological labs for mixing and tempering samples, solutions, substances, etc. which are in appropriate lab-type typical containers 150. Such containers 150 may be tubes of plastic material having a volume of 0.2 ml to 2 ml, which can be closed at an upper end portion with a small cap. Many of such tubes 150 may be processed simultaneously.

Tempering can be effected by bringing the sample 150 to desired temperatures which may be defined specifically for a particular application (for instance between room temperature and 100° C., but also up to −5° C.), which shall be maintained for a specific time interval as precisely as possible. The transition between a desired temperature and another temperature shall be as fast as possible.

When processing simultaneously a plurality of devices 150, a homogeneous tempering of all devices 150 is desired, in order to have the same quality of the reaction in all tubes 150. This may be obtained by a thermo-block 104 of a material (such as aluminium) which is thermally conductive, and by receiving the tubes 150 in correspondingly shaped recesses 112 which are connected to a heat source 113 (or a heat sink for cooling).

For realizing a mixing motion of the tubes 150 together with the thermo-block 104, the tubes 150 can be brought to spatially fixed planar circular motions having an orbit of, for instance, 2 mm to 3 mm. However, also linear motions or arbitrary motions in three dimensions are possible.

Embodiments of the invention have the advantage that the motion amplitude is essentially constant even when an excitation frequency (for instance 0 to 2.500 rounds per minute or more) is changed, since in contrast to conventional approaches, an undesired increase of the vibration amplitude with increasing excitation frequency may be prevented.

Eccentric drives do not suffer from this problem, here the amplitude may be kept constant over the entire frequency region. Thus, embodiments of the invention make it possible that the desired motion geometry (for instance 3 mm orbit motion) can be generated on the basis of the original motion of the drive (for instance rotational motion of an engine.).

According to an exemplary embodiment of the invention, a single heat source 113 (for instance a heat cartridge, a heat foil, a heat resistance, a Peltier element) is centrally arranged or located within a thermo-block 104. Around the heating source 113 or heating sink, the sample tubes 150 are arranged, preferably all at the same distance from the heat source 113 or heat sink. Therefore, a radially symmetric temperature profile generated by the heat source 113 and the isotropy of the thermal-block 104 is sufficient to achieve an equilibrated tempering of all tubes 150 arranged in such a manner. The necessity of the generation of a flat temperature profile over the entire thermo-block 104 is dispensable according to embodiments of the invention. This may reduce the required heat paths and may allow for a compact manufacture.

The motion in a plane may be realized using a sandwich principle. That is to say, the moved element (base plate 103 for the thermo-block 104) may be fixed between two outer guide plates 107, 108 and can move on balls 109 being provided thereon (for instance a bearing preventing a single degree of freedom regarding motion). With such a concept, each motion form within a plane is possible. According to an exemplary embodiment, a conversion of an eccentric motion of the drive to a fixed planar orbital motion of the block 104 is possible using correspondingly aligned magnetic fields. For example, on the thermo-block 104 ground plate 103, (permanent) magnets 110 are aligned in such a manner that they move between corresponding magnets 111 at the outer guide plates 107, 108. The geometrical arrangement is selected in such a manner that the motion in the two dimensions of the plane is enabled, but a twisting or drilling of the plate 103 is prevented by the magnetic interaction.

With a contact-free magnetic field guide, it is also possible to obtain other motion forms, also in one or three dimensions. The above-mentioned sandwich bearing 109 with balls can then be substituted (for instance by similar magnetic guides). The ball bearing 109 is realized in the above-described embodiment, since the motion shall only be performed in one plane, and on the other hand the eccenter or the thermo-block ground plate is only radially fixed, so that no moment of tilt has to be received.

According to an exemplary embodiment of the invention, surrounding air may be used as an isolating (in a resting operation state of the air) or heat transporting (in a moved operation state of the air) medium. The block 104 to be tempered may be surrounded essentially entirely by an air cushion, wherein the geometry of such an air cushion may be defined by the shape and dimension of the housing and the basic elements. When heating the block 104 above surrounding temperature (for instance room temperature), the resting air may serve as a thermal isolator and may prevent losses. If a cooling is desired later, the air can be accelerated by providing a blower 118 (such as a ventilator) at a position of the air volume, which blower 118 sucks the surrounding air and moves the air in a defined manner around the thermo-block 104. By taking this measure, the heat may be transported off the surface of the block 104, and may be transferred to an exterior of the device 100 by suitable openings. Such a cooling effect may be promoted by an appropriate choice of the streaming properties, for instance by adjusting geometry, blower, etc.

A cover 116 of the thermo-block 104 at an upper side may be realized as a hinged lid, which may comprise a heating system 117 (cover heating) which may realize a temperature being several Kelvin above the temperature of the sample carrier block 104. By taking this measure, convection or condensing of sample material on walls of the tube 150 may be prevented. The mechanical and electrical connection between the cover 116 and the remainder of the device 100 may be realized by a detachable contact, so that the cover 116 does not only have to be opened by pivoting, but can also be taken off entirely. An engaging closure of the cover 116 may also be realized by magnetic forces.

The mixing motion may result in unbalanced masses due to the accelerated masses of the block 104 and the tubes 150. Vibration motions generated as a consequence of such effects may be reduced/diminished by a compensation of the static and the dynamic imbalances internally of the device 100, by using at least one mass equilibration element 105, 106.

In such a context, the centers of gravities of the thermo-block 104 and the compensation masses 105, 106 are not necessarily on the same height. When properly adjusted, there are no vibrations or other undesired motions of the device 100. However, it is also possible to compensate partially or entirely torque which is generated during the acceleration. The rotational moment of inertia which may occur with such moved masses 105, 106 may result in a gentle reduced acceleration when turning the device 100 on and off, so that a complex regulation unit for such purposes may be dispensable. The mass equilibration elements 105, 106 may also be provided with wings or blades, so that their motion results in an additional cooling effect, for instance to cool control electronics located in an environment of such moving compensation masses 105, 106.

According to an exemplary embodiment of the invention, a tempering and mix function may be realized within one and the same system.

Figure 2:
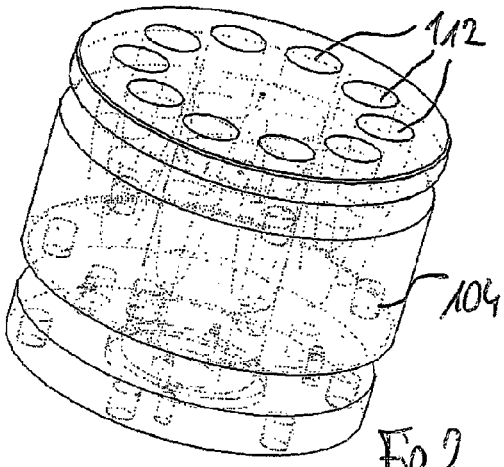
FIG. 2 to FIG. 5 illustrate a sample carrier block of a sample handling device according to an exemplary embodiment of the invention.

FIG. 2 shows a three-dimensional view of a thermo-block 104 having a plurality of sample receptions 112. As can be taken from FIG. 2, the thermo-block 104 has a cylinder-symmetric shape and allows for a homogeneous tempering, since the sample receptions 112 are aligned on a circular trajectory.

Figure 3:
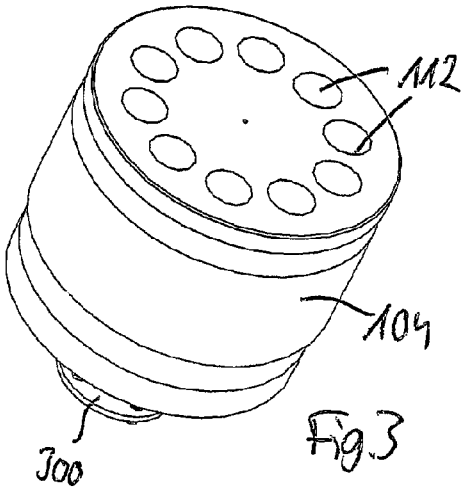
Figure 5:
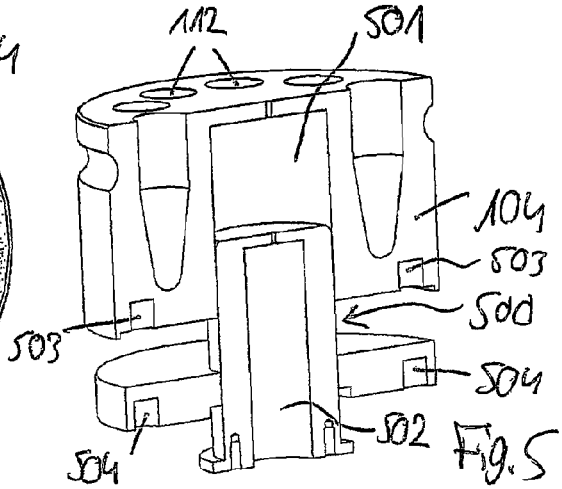

FIG. 3 again shows the sample carrier block 104 with a base portion 300 of a heater element 500 which may be inserted in an interior recess 501 of the thermo-block 104 (see FIG. 5).

This configuration has the advantage that the reaction chambers 112 are provided at the same distance to the heat source 500, namely on a circular trajectory. A homogeneous tempering is possible with such a symmetry even with short heat paths. Therefore, a compact construction (heat source 500 within the block 104) is possible.

Figure 4:
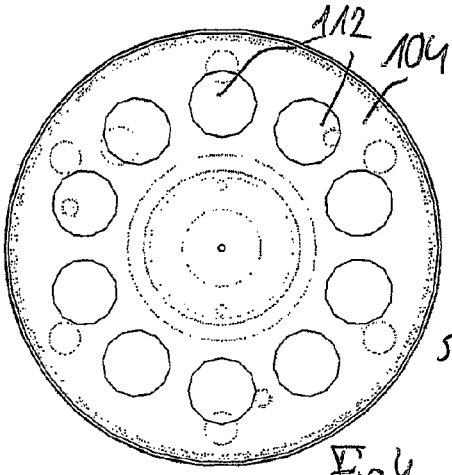

FIG. 4 shows a plan view of the sample carrier block 104 showing the circular trajectory of the containers 112.

FIG. 5 shows an explosion view of the sample carrier block 104 and of the heater element 500 which may be received within the recess 501 of the block 104. The detachable thermo-block 104 is shown as well as a chamber 502 adapted for receiving the actual heating source such as a heating cartridge.

Magnetic elements 503 provided in a lower portion of the sample carrier block 104 are formed to cooperate with magnetic elements 504 formed in the heating element 500, so that insertion of the heating element 500 in the recess 501 may allow for an automatic fixation of the heating element 500 at the sample carrier block 104 due to an attracting magnetic force between the permanent magnets 503 and 504.

Next, further details regarding the tempering features will be explained.

The heat source may be provided centrally in the recess 502. An active cooling may be performed by an air stream (which may be realized by a miniature regulatable turbo blower or by a Peltier or heat pipe/cooler). A cover heating 117 may be provided as well. Furthermore, due to the magnetic fastening using the elements 119, 120, the cover 119 may be detached.

Coming back to the tempering, the central heat source/sink may be arranged in the geometrical center of the tube arrangement, for instance as a heating cartridge. Therefore, no flat temperature profile is necessary, as in conventional planar approaches. The radial symmetry of the alignment of the tubes in the basis 112 is sufficient for a homogeneous heat distribution. For heating, the thermal isolation of the block to an exterior position may be used, so that an air gap may be provided between the housing and the environment, and the resting air serves as a proper thermal insulator. For cooling, the blower may be switched on, and the geometry of the previously isolating air gap may be used for guiding off heat during motion of the air, wherein blades at a housing may be provided which may be opened by the air stream.

Figure 6:
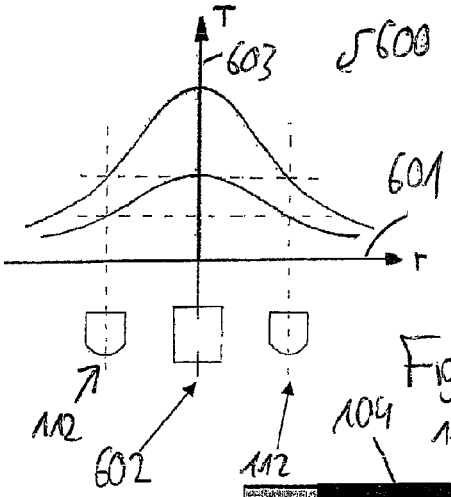
FIG. 6 and FIG. 7 are diagrams illustrating temperature distributions within sample handling devices.

FIG. 6 shows a diagram 600 having an abscissa 601 along which a distance from a heat source 602 is shown. Furthermore, positions of the tubes 112 are shown as well for a configuration of a sample handling device according to an exemplary embodiment of the invention. Along an ordinate 603 of the diagram 600, the temperature is plotted. Each radially symmetric temperature profile (as the curves shown in FIG. 6) is possible to generate the same temperature in all tubes 112.

Figure 7:
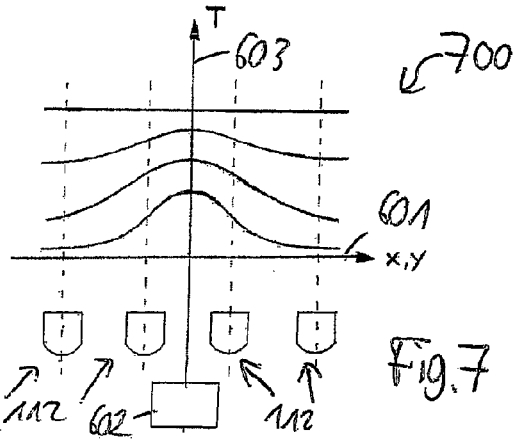

In contrast to this, a diagram 700 is shown in FIG. 7. In such a configuration of a conventional sample handling device, the distance between the heat source 602 and the sample containers 112 is different, so that only a flat temperature profile (most upper curve in FIG. 7) allows to obtain the same temperature in all tubes 112.

Figure 8:
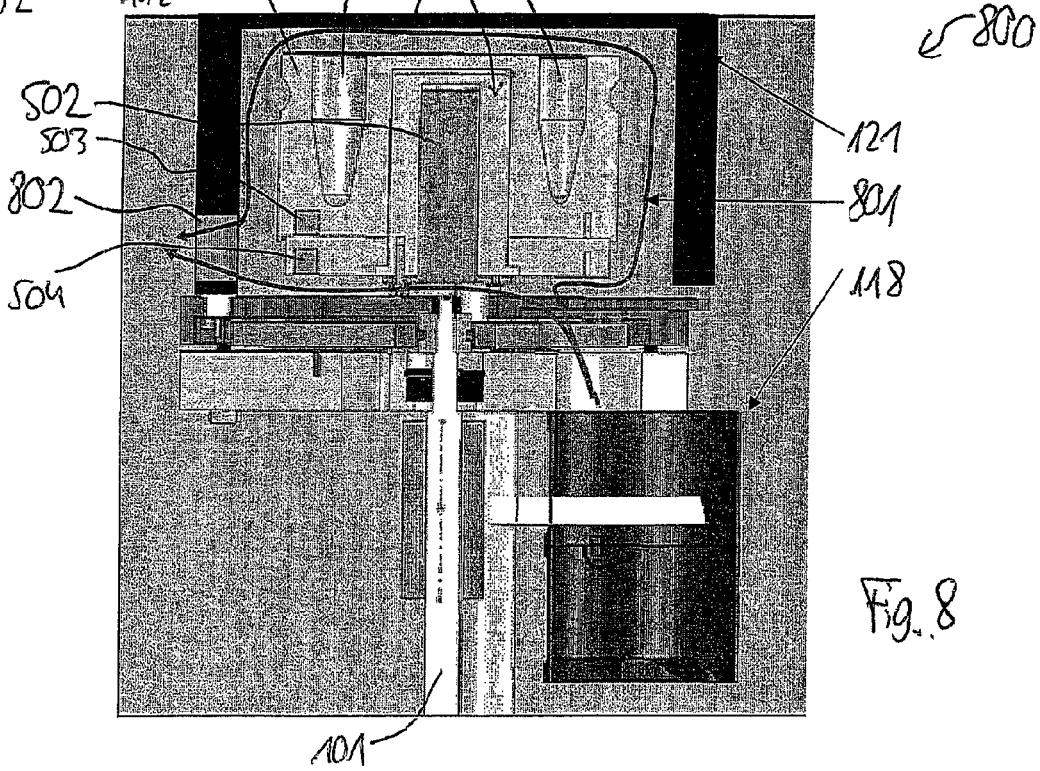
FIG. 8 is a cross-sectional view of a sample handling device according to an exemplary embodiment of the invention.
Figure 9:
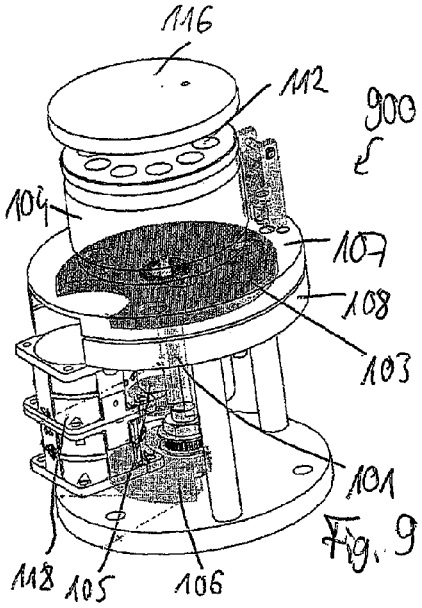
FIG. 9 to FIG. 12 are three-dimensional views of components of a sample handling device according to an exemplary embodiment of the invention.

FIG. 8 shows a cross-sectional view of a sample handling device 800 according to another exemplary embodiment of the invention.

FIG. 8 schematically illustrates an air stream 801 generated by the blower 118 which air stream 801 flows around the block 104 to perform a simultaneous cooling of all samples 112, wherein the moved air then exits via one or more exit openings 802.

FIG. 9 to FIG. 12 show further three-dimensional views of a sample handling device 900 according to an exemplary embodiment of the invention.

Aspects regarding illumination or suppression of vibrations can be taken from FIG. 9 to FIG. 12.

By a compensation of all undesired static and dynamical unbalances by an active mass equilibration system 105, 106 interior of the device 900, a rotating mass equilibration system may be used efficiently for the generation of a cooling air stream, for instance for cooling electronic devices (not shown). Compensation masses 105, 106 compensate all static and dynamic unbalances, and simultaneously allow for a lightweight construction (in contrast to conventional approaches which use a heavy ground plate). Thus, vibrations may be efficiently suppressed, and the acceleration may be gentle due to a larger rotation moment of inertia (so that a corresponding control unit may be dispensable). The moving masses 105, 106 may also be used as a fan to cool components such as an electronic.

Figure 10:
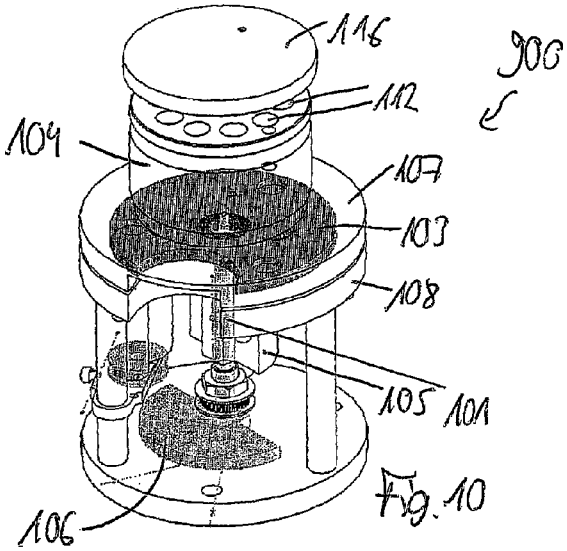
Figure 11:
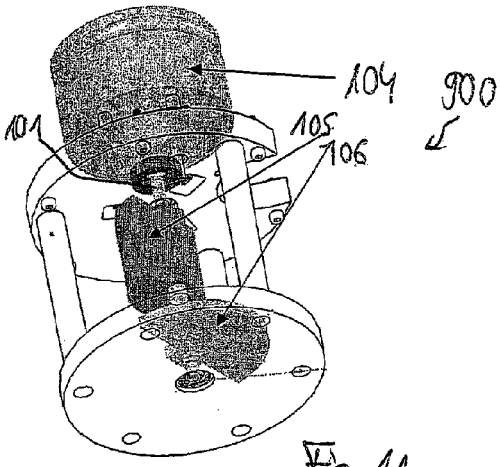
Figure 12:
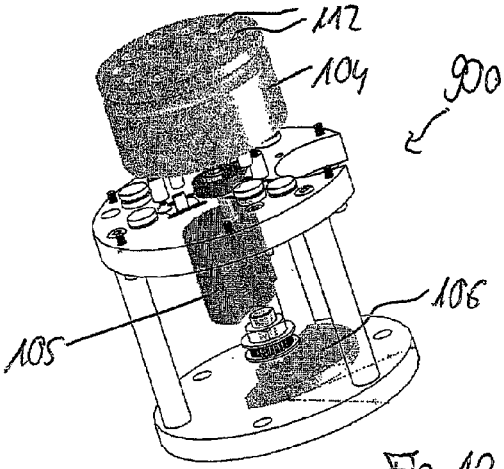

Particularly FIG. 10 shows the main mass (block) 104, and the equilibration weights 105, 106 for static and dynamic equilibration.

In the following, the magnetic field guiding will be explained in more detail.

An engine driven eccentric motion may be converted into an orbital/linear motion by a contact-free magnetic field guiding. For this purpose, a (ball) bearing 109 can be constructed in a sandwich construction for a two-dimensional forced guide (x and y are free, z is fixed, wherein z is the vertical axis).

Thus, the generated device is wear-free, shows no aging effects, does not perform gyration (in contrast to conventional rubber buffers), allows for a modification of the characteristic curves by moving the position of the magnets, and prevents mechanical connections to the basis of the device.

Figure 13:
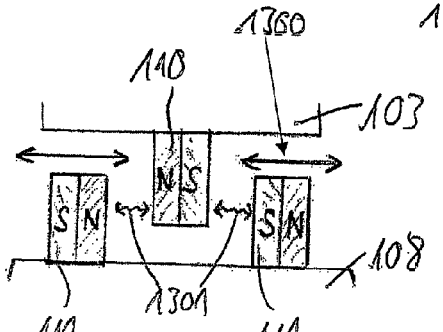
FIG. 13 and FIG. 14 illustrate a magnetic guiding system between a base plate and guiding plates of a sample handling device according to an exemplary embodiment of the invention.
Figure 14:
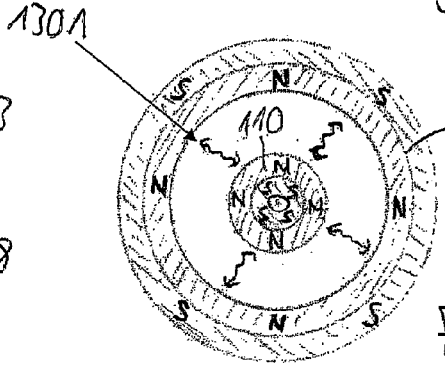

FIG. 13 and FIG. 14 show magnetic configurations using the same reference numerals as in FIG. 1. Arrows 1300 indicate a shift for adjusting the force at the working distance. Reference numeral 1301 illustrates magnetic interactions.

Figure 15:
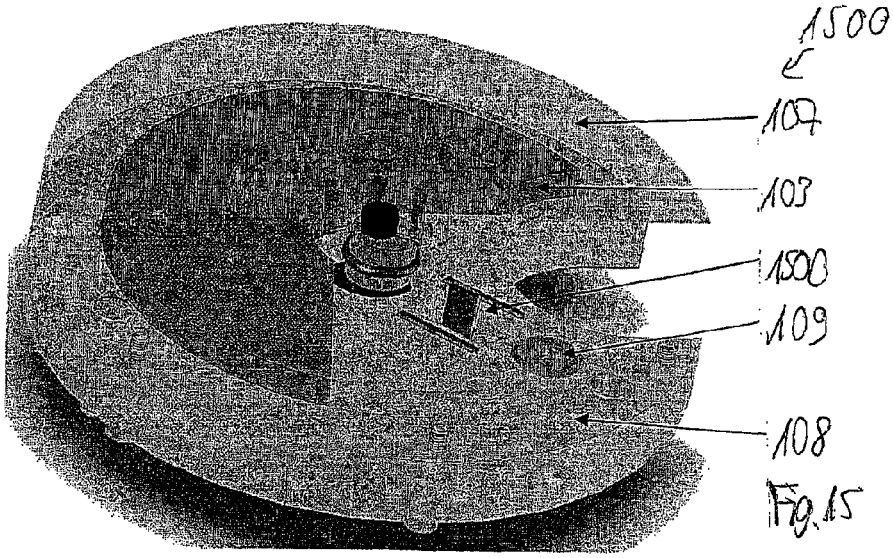
FIG. 15 to FIG. 18 are different views of a part of a sample handling device according to an exemplary embodiment of the invention.

FIG. 15 shows a sample handling device 1500 according to an exemplary embodiment of the invention, in which the upper guide plate 107, the moved element 103, a magnetic guide 1500, a ball bearing 109 with two degrees of freedom (on an upper portion and on a lower portion), as well as a lower guide plate 108 are shown.

Figure 16:
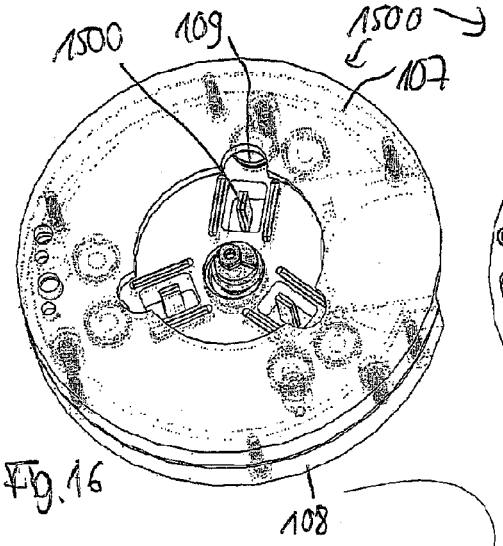
Figure 17:
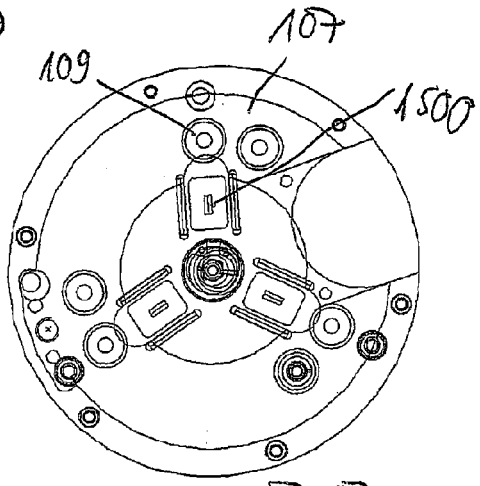

FIG. 16 and FIG. 17 further illustrate such an embodiment in plan views.

Figure 18:
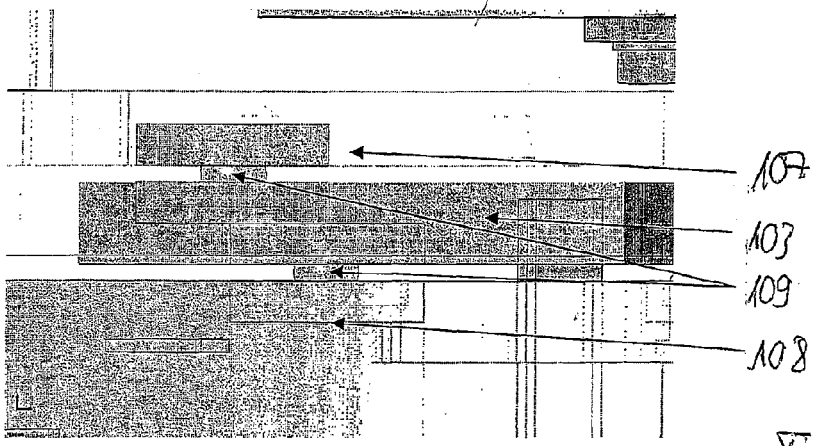

FIG. 18 illustrates the sandwich principle.

Exemplary embodiments of the invention may be integrated in existing robot systems. For instance, it is possible to combine the thermo-shaker with an automated pipetting device for automatically pipetting substances or samples in the sample containers 112.

Figure 19:
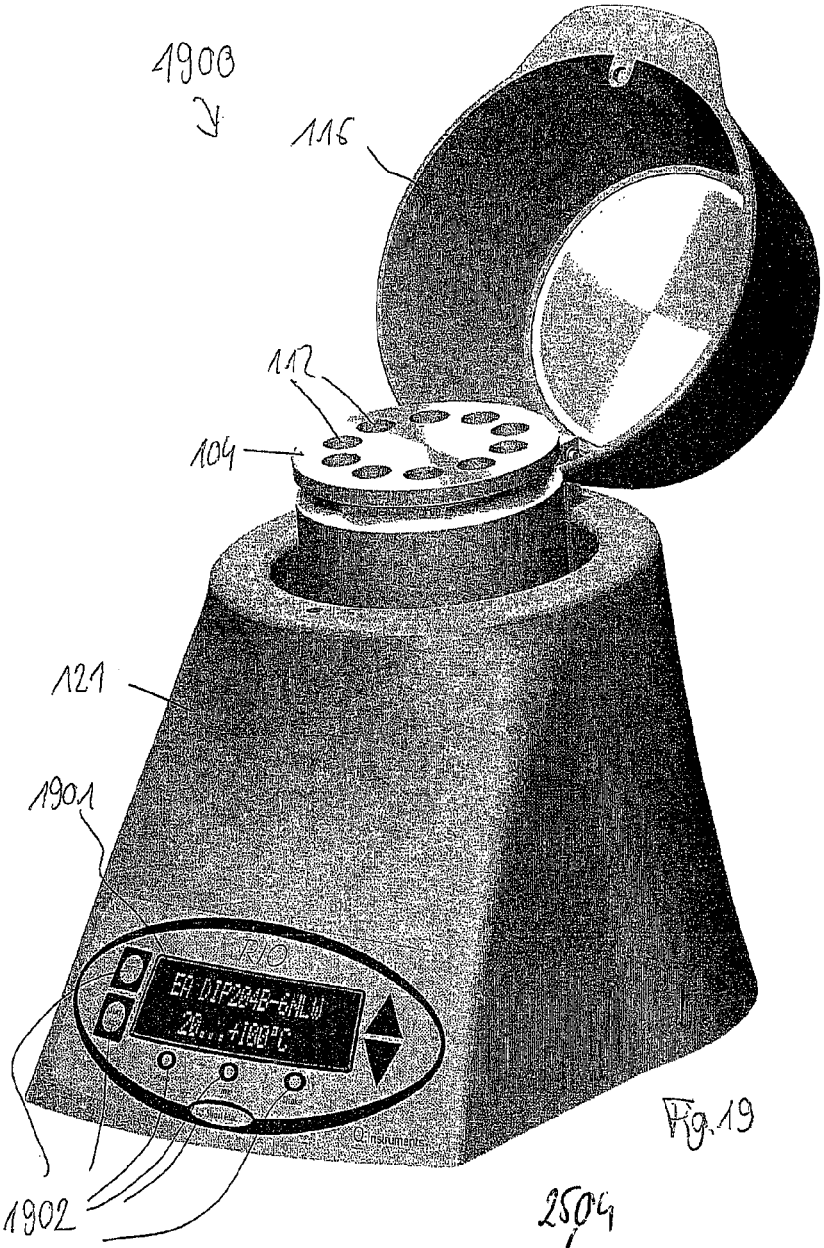
FIG. 19 is a three-dimensional view of an assembled sample handling device according to an exemplary embodiment of the invention.

FIG. 19 shows a three-dimensional view of an apparatus 1900 according to an exemplary embodiment of the invention.

A display 1901 such as an LCD display is shown to output, for a user, information regarding the operation of the device 1900. Furthermore, a plurality of buttons 1902 are provided for operating the device.

Figure 20:
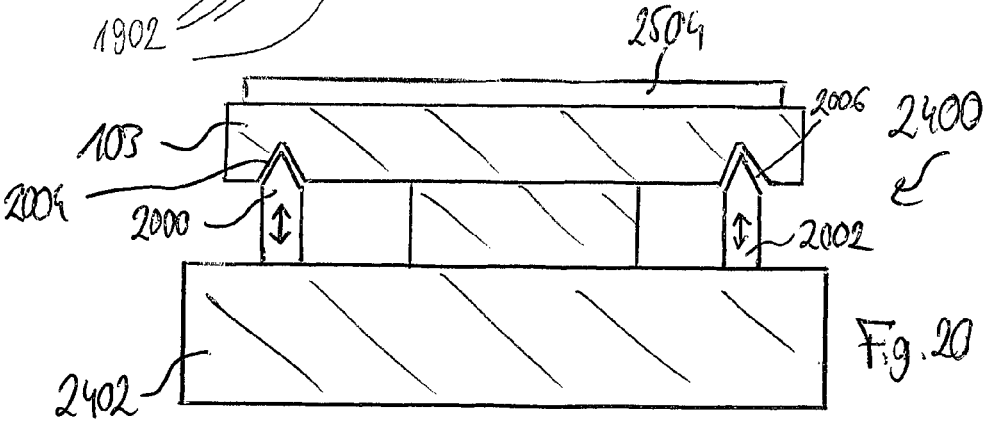
FIG. 20 illustrates a sample handling device according to an exemplary embodiment of the invention having a centering plunger arrangement.

FIG. 20 schematically shows a cross-sectional view of a sample handling apparatus 2400 according to an exemplary embodiment of the invention. This apparatus 2400 will be explained below in more detail referring to FIG. 24.

The sample handling device 2400 comprises centering plungers 2000, 2002 arranged in a movable manner within a support element 2402 and being adapted to be moved (see arrows) to project out of the support element 2402 and to abut against a lower surface of a base plate 103 to thereby drive back the base plate 103 to a central position.

The centering plungers 2000, 2002 are adapted to be moved to project out of the support element 2402 upon switching off the drive unit 102. In such a scenario, it may be desired that the sample handling device 2400 is brought to a default position, for instance to allow a robotic needle system (not shown) to be accurately positioned relative to the sample handling device 2400, for instance to allow the needle to remove mixed sample material from sample containers of a microtiter plate 2504 mounted on the base plate 103. The centering plungers 2000, 2002 are conically shaped. Centering holes 2004, 2006 are formed in a lower surface of the base plate 103 and are shaped correspondingly to the assigned centering plungers 2000, 2002 to be engageable by the centering plungers 2000, 2002 when being moved to project out of the support element 2402.

Generally, the magnetic field guiding mechanisms described herein are not limited to attractive forces, but also may involve repulsive magnetic forces. Also a superposition of attracting and repulsive forces is possible.

Figure 21:
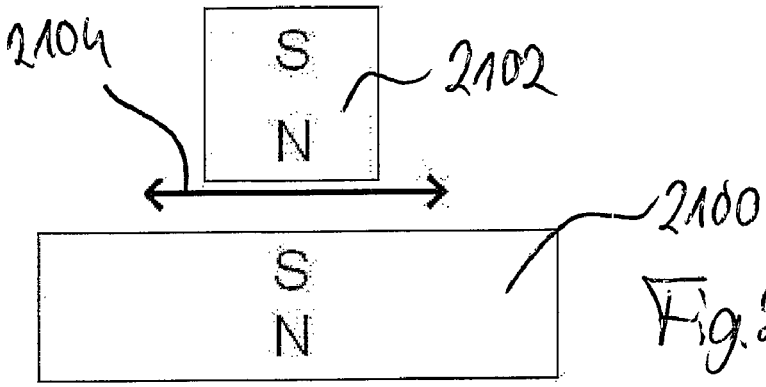
FIG. 21 schematically illustrates a lateral motion of magnets in an attracting force configuration of a sample handling device according to an exemplary embodiment of the invention.

FIG. 21 shows a magnetic configuration of a first magnetic element 2100 and a second magnetic element 2102. These two permanent magnets 2100 and 2102 may not only be arranged in a vertical manner above one another according to FIG. 21, i.e. approaching one another or departing from one another, but they may also be moved in a lateral manner 2104 ("shearing").

In an embodiment of a magnetic field guiding mechanism, it is possible that the gravitational force of the mass to be moved (base plate, thermo block, tubes, etc.) can be compensated by magnetic forces of different amplitudes, so that frictional losses in the context of a bush bearing mechanism may be further reduced. This can be achieved by a control or regulation of the distance of individual magnets relative to one another or by implementing magnets of different sizes.

Figure 22:
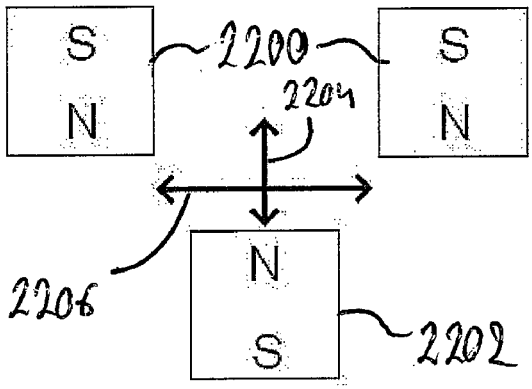
FIG. 22 schematically illustrates a lateral motion of magnets in a scenario of a repulsive force of a sample handling device according to an exemplary embodiment of the invention.

FIG. 22 shows a magnetic configuration in which first and second magnetic elements 2200 are provided adjacent to one another and in cooperation with a third magnet 2202 to provide for a vertical motion 2204 and a lateral or horizontal motion 2206.

Figure 23:
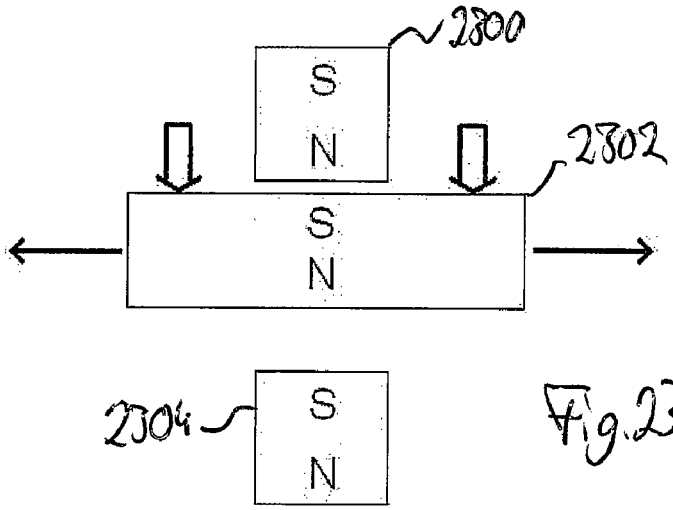
FIG. 23 schematically shows a magnetic configuration with an additional compensation of a present force such as a gravitational force by an appropriate configuration of the magnetic guide mechanism of a sample handling device according to an exemplary embodiment of the invention.

In the embodiment of FIG. 23, a first magnet 2300 and a second magnet 2302 may be provided with different sizes to generate magnetic forces of different amplitudes. A further magnet 2304 is arranged to attract the second magnet 2302, whereas simultaneously an attracting force is exerted between the magnets 2300 and 2302. In the embodiment of FIG. 23, a resulting magnetic force component may at least partially compensate a weight force. A guiding task can be performed simultaneously.

Figure 24:
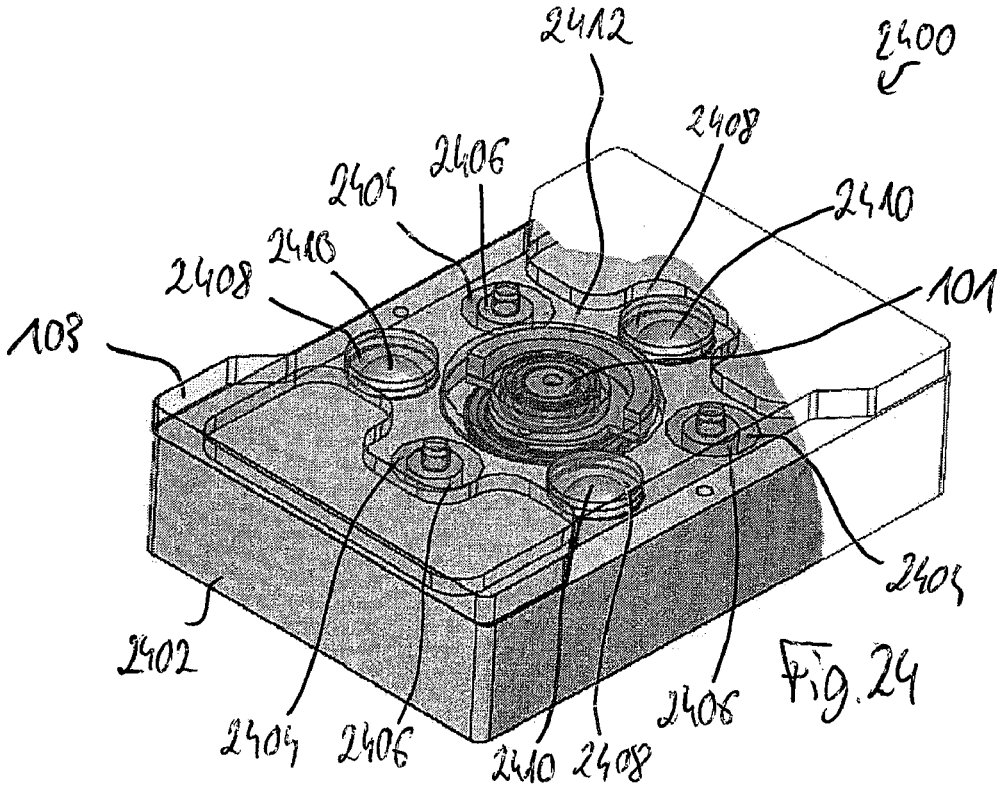
FIG. 24 illustrates a three-dimensional view of a sample handling device according to an exemplary embodiment of the invention.

FIG. 24 illustrates a sample handling device 2400 according to an exemplary embodiment of the invention. FIG. 24 shows the sample handling device 2400 in a partially transparent illustration.

The sample handling device 2400 is adapted for handling a fluidic sample which is not shown in FIG. 24. The sample handling device 2400 comprises a drive shaft 101 being drivable by a drive unit which is provided within a support element 2402. A base plate 103 is mounted above the support element 2402 to follow a motion of the drive shaft 101 when being driven by the drive unit. The base plate 103 is configured to receive a sample carrier block, namely a microtiter plate 2504 shown in FIG. 25, as a sample carrier block, mountable on the base plate 103 to follow a motion of the base plate 103. In the embodiment of FIG. 24, a single compensation weight 2412 is mounted on the drive shaft 101 in a manner to at least partially compensate an unbalanced mass of the sample handling device 2400 during the motion.

Figure 25:
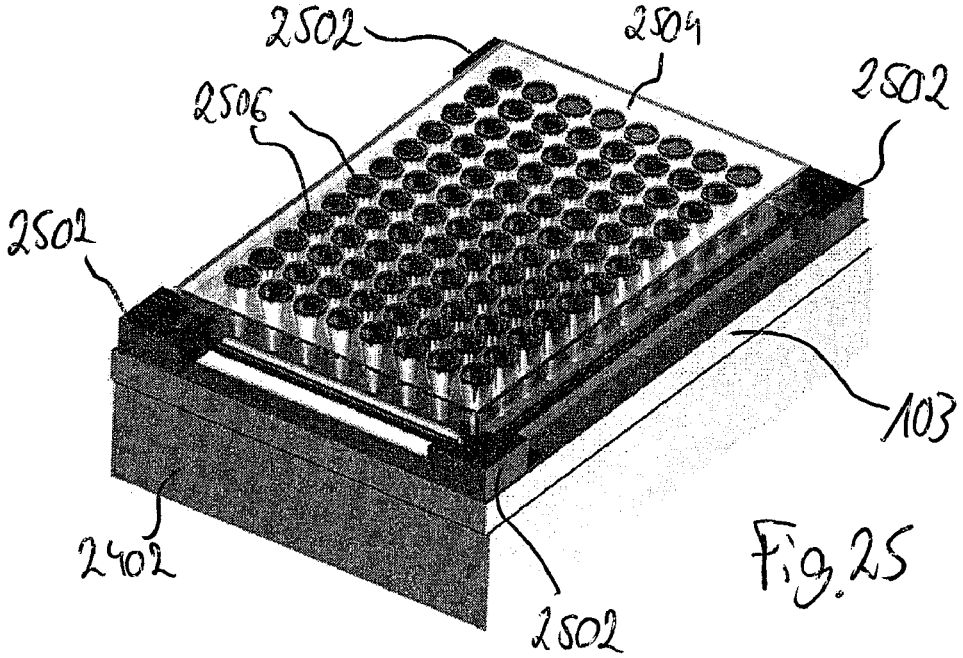
FIG. 25 shows the sample handling device of FIG. 24 with a microtiter plate mounted thereon.

As can be taken from FIG. 25, the sample carrier block 2504 is a microtiter plate having 96 matrix-like arranged wells or fluid containers 2506.

The support element 2402 is adapted to at least partially accommodate the drive shaft 101 and the drive unit. The base plate 103 is (detachably) mountable on the support element 2402.

The support element 2402 comprises three guide holes 2404. The base plate 103 comprises three guide pins 2406 each configured to correspond to a respective one of the guide holes 2404 so that the base plate 103 is mountable on the support element 2402 by inserting the three guide pins 2406 into the three guide holes 2404 with a certain amount of clearance allowing for a shaking motion of the base plate 103 together with the microtiter plate 2504.

Figure 27:
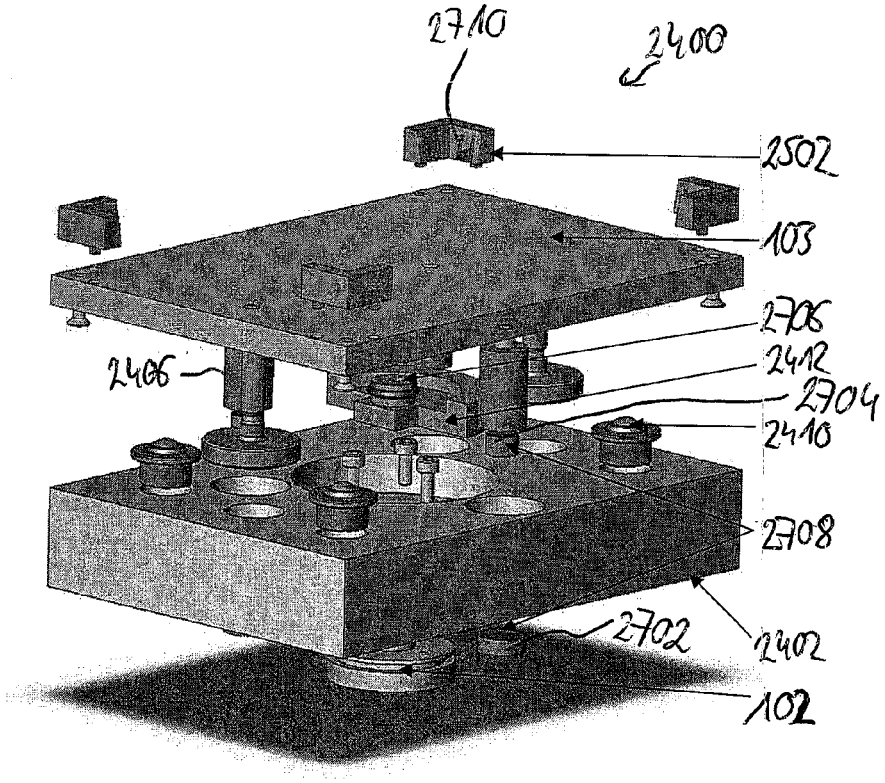
FIG. 27 illustrates a microtiter plate shaker according to an exemplary embodiment of the invention.

As can be better seen in FIG. 27, first permanent magnets 2702 are arranged in an interior of each of the guide holes 2404. Second permanent magnets 2704 are provided on each of the three guide pins 2406. The first permanent magnets 2702 and the second permanent magnets 2704 are configured to attract one another, i.e. to generate an attracting magnetic force.

Coming back to FIG. 24, the support element 2402 further comprises three bearing holes 2408. The base plate 103 comprises, as can best be seen in FIG. 34, three bearing holes 3402 configured to correspond to the first bearing holes 2408.

Moreover, three balls 2410 are provided and arranged partially within the first bearing holes 2408 and partially within the second bearing holes 3402 to thereby form a ball bearing between the support element 2402 and the base plate 103. When the base plate 103 is assembled on top of the support element 2402, a point contact between the balls 2410 and a bottom surface of the base plate 103 provides for a planar support. The balls 2410 are made of Torlon (polyamide-imide). Torlon may be denoted as a glass fiber reinforced polyamide.

The sample handling device 2400 further comprises third permanent magnets arranged in the bottom of the first bearing holes 2408 and correspondingly arranged fourth permanent magnets arranged in an interior of the bearing holes 3402. These third and fourth permanent magnets are configured to attract one another to support the base plate 103 on the support element 2402.

As can be taken from FIG. 24 and FIG. 25, the base plate 103 has an essentially rectangular shape. Only in corner portions thereof, a slight deviation from the rectangular shape can be seen. Also the support element 2402 has an essentially rectangular shape dimensioned to correspond to the rectangularly shaped base plate 103. As can be taken from FIG. 25 and FIG. 27, four engagement corner elements 2502 are arranged in the four corners of the base plate 103 and are adapted for engaging the microtiter plate 2502. Flat springs 2710 are provided in these corner elements 2502 so as to provide a snap-in connection of the microtiter plate 2504 with the base plate 103 with a single hand motion of a user.

In contrast to the configuration of, for instance, FIG. 1, the embodiment of FIG. 24 has exactly one compensation weight 2412 shaped as a half annular element which has a center of gravity arranged basically at the same vertical level as a center of gravity of the cooperatively moving base plate 103 and the sample carrier block 2504.

Figure 34:
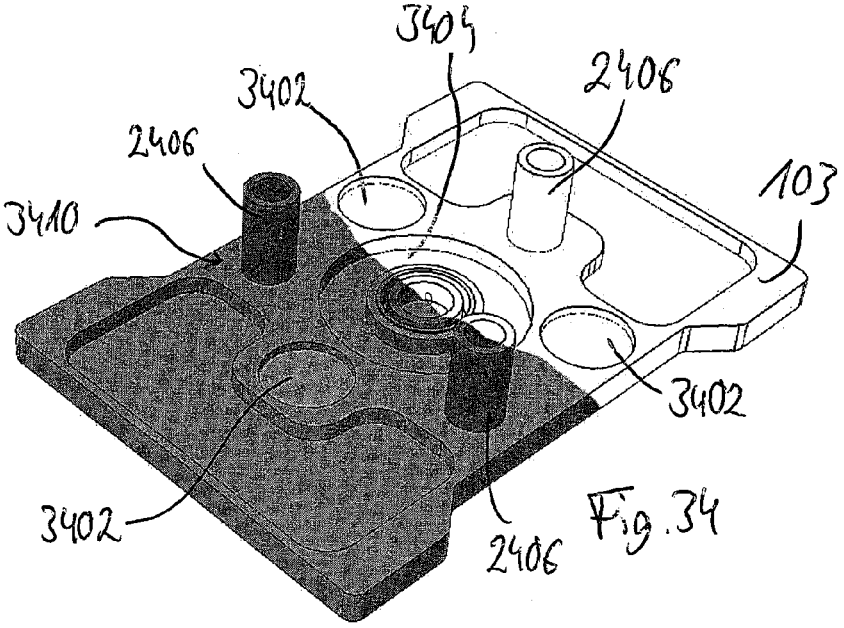
FIG. 34 shows a bottom view of the base plate of FIG. 33.

As can be taken from FIG. 34, the base plate 103 has a recess 3404 at a bearing surface 3410 opposing a sample surface 3310 at which the sample carrier block 2504 is mountable. A part of the single compensation weight 2412 is receivable within the recess 3404 when the base plate 103 is mounted on the support element 2402.

As an alternative to a planar bearing by the balls 2410, it is also possible to provide sliding elements (for instance planar annularly shaped disks or individual distributed sliding provisions) as load receiving bearings.

Figure 26:
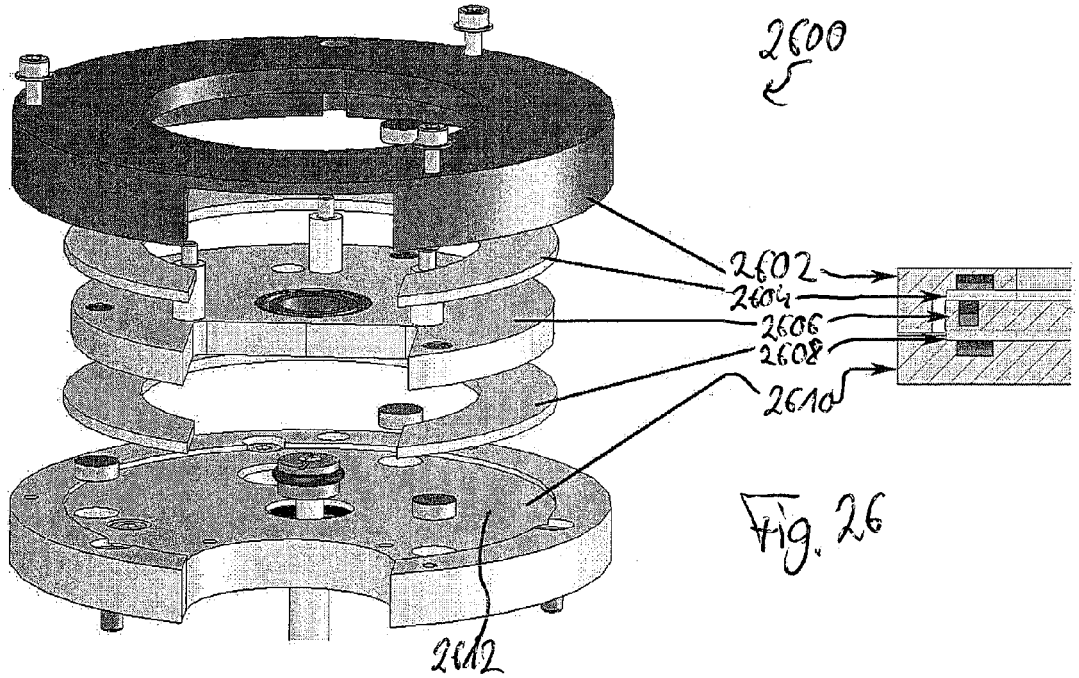
FIG. 26 illustrates a construction of a planar bush bearing in combination with a magnetic guide mechanism and a compensation of the gravitational force according to a sandwich principle implemented in a sample handling device according to an exemplary embodiment of the invention.

Such an embodiment is shown in FIG. 26.

The sandwich bearing 2600 shown in FIG. 26 comprises a guide plate 2602, a bearing 2604, a base plate 2606, a bearing 2608, and a guide plate 2610.

The bearings 2604 and 2608 may be IGLIDUR bearings (IGLIDUR J200 of IGUS GmbH, www.igus.de). The only movable element in the sandwich architecture of FIG. 26 is the base plate 2606 which may be made of a hard anodized aluminium alloy. The surface of this element may be characterized by Ra=0.4 μm.

Reference numeral 2612 denotes an adhering surface for the IGLIDUR disk 2608. The IGLIDUR disk 2604 is adhered to a (not shown) surface of the guide plate 2602.

Coming back to the embodiment of FIG. 24, a heating may be implemented particularly in the base plate 103 or in another component of the sample handling device 2400. Apart from an ohmic heating element and a heat transfer by a thermo block, it is also possible to supply heat using heated air (hot air blowing), wherein the sample containers 2506 may be brought in thermal contact with the hot air. The containers 2506 may then be arranged freely hanging in a support such as a mesh. A continuous flow of air (for instance using a ventilator) may ensure a homogeneous heating or cooling. It is possible to heat with different heat sources, such as heat wires.

Particularly in an embodiment in which a microtiter plate 2504 is provided, tempering may be performed by heating foils heating a complete area of the microtiter plate 2504. It is possible to locally vary the heating power, for instance in order to compensate for heat losses at the edges of the microtiter plate 2504. It is possible that a heater can blow air onto a bottom of the microtiter plate 2504.

In the context of the microtiter plate shaker 2400, a sandwich construction such as in FIG. 1 may be dispensable. Due to the geometrical conditions of FIG. 24, a balancing of an unbalanced weight can be performed with a balancing mass 2412 at the same vertical level of the center of gravity of the moved mass so that no tilting effects occur. The vertical force component of the guiding magnets may be sufficient in order to maintain the shaking base plate 103 on the bearing provided by the balls 2410 or sliding elements.

FIG. 27 shows a partially exploded view of the sample handling device 2400. FIG. 27 particularly shows the positioning and support corners 2502, the temperable base plate 103 for receiving the microtiter plate 2504, the eccenter 2706 of the drive shaft 101, the semi-annular compensation weight 2412, the balls 2410 of the ball bearing, and the magnetic guide system 2708 for generating the fixed planar orbital motion. Furthermore, the support element 2402 is shown. FIG. 27 shows as well the motor 103, particularly a flat motor, for driving the drive shaft 103.

Figure 28:
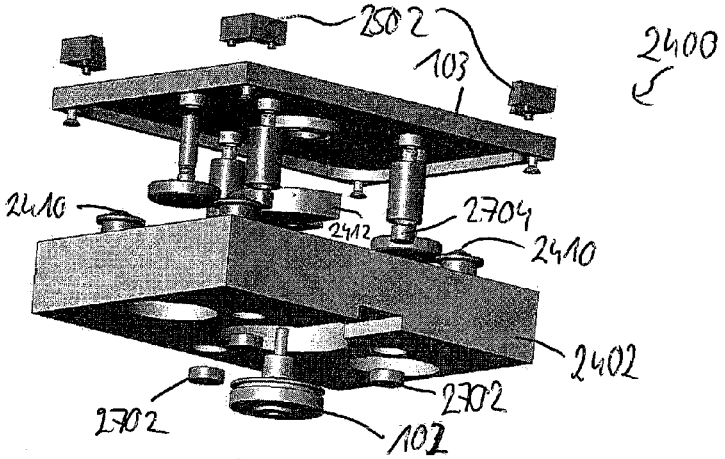
FIG. 28 illustrates another view of the microtiter plate shaker of FIG. 27.

FIG. 28 shows another view of the sample handling device 2400 from a bottom position.

Figure 29:
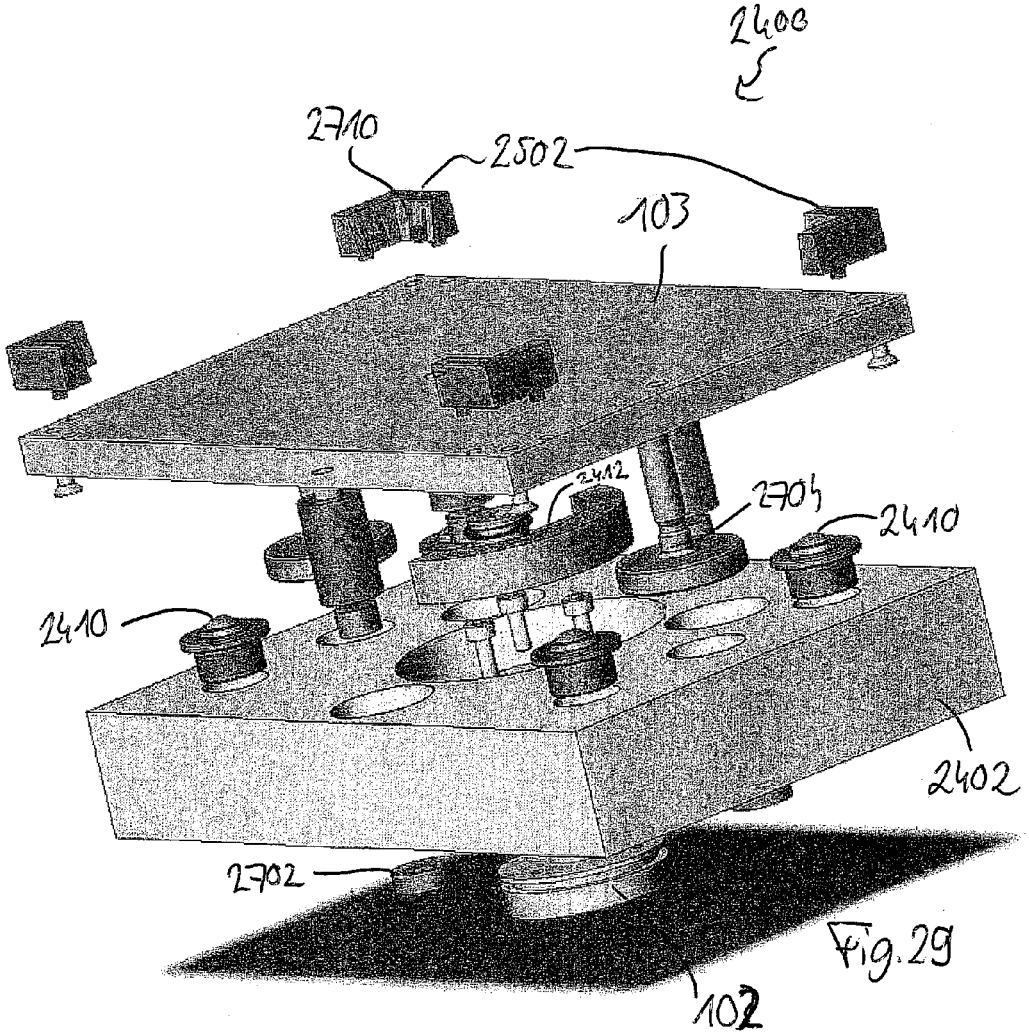
FIG. 29 illustrates still another three-dimensional view of the microtiter plate shaker of FIG. 27 and FIG. 28.

FIG. 29 is another three-dimensional view of the sample handling device 2400 similar to FIG. 27.

Figure 30:
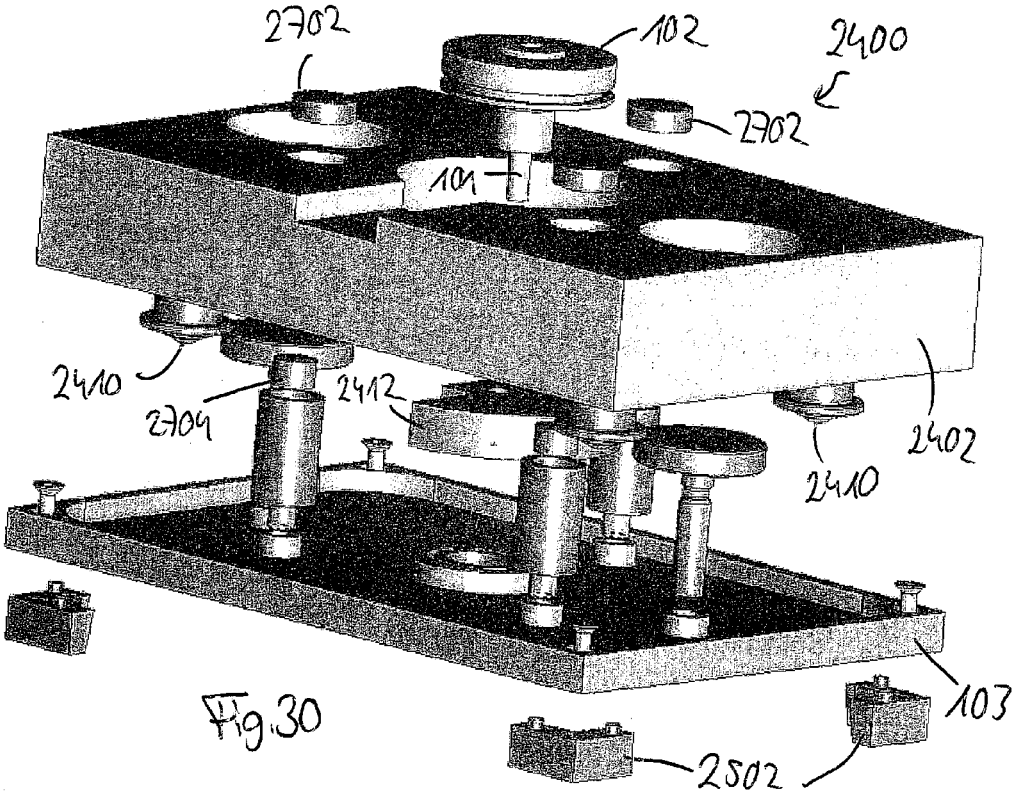
FIG. 30 shows a further view of the microtiter plate shaker of FIG. 27 to FIG. 29 according to an exemplary embodiment of the invention.

FIG. 30 is a view similar to the view shown in FIG. 28 of the sample handling device 2400.

Figure 31:
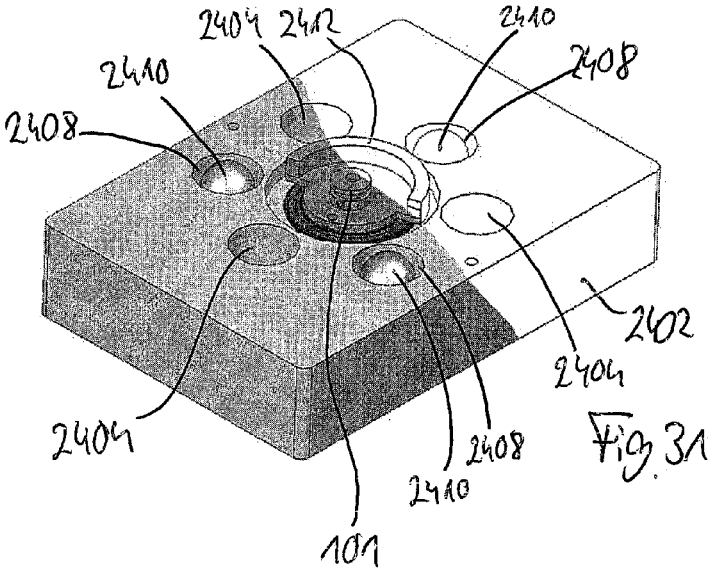
FIG. 31 shows a top view of a support element of a sample handling device according to an exemplary embodiment of the invention.

FIG. 31 shows the support element 2402 without base plate 103.

Figure 32:
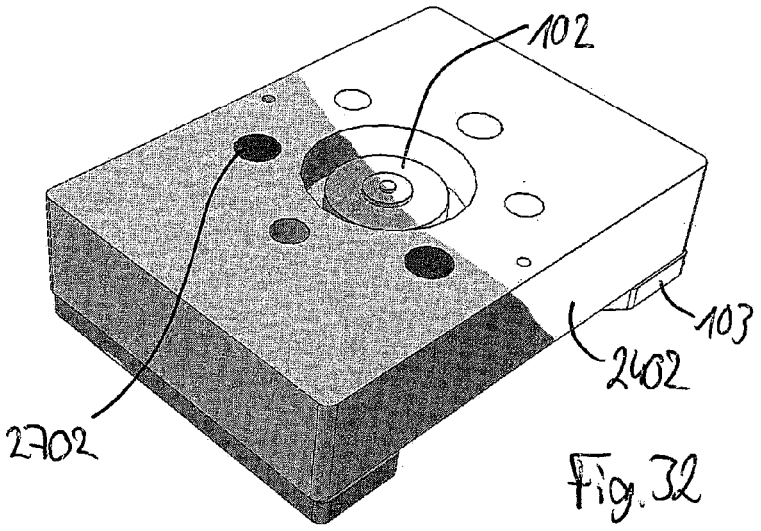
FIG. 32 shows a bottom view of the support element of FIG. 31.

FIG. 32 shows the support element 2402 from a bottom position.

Figure 33:
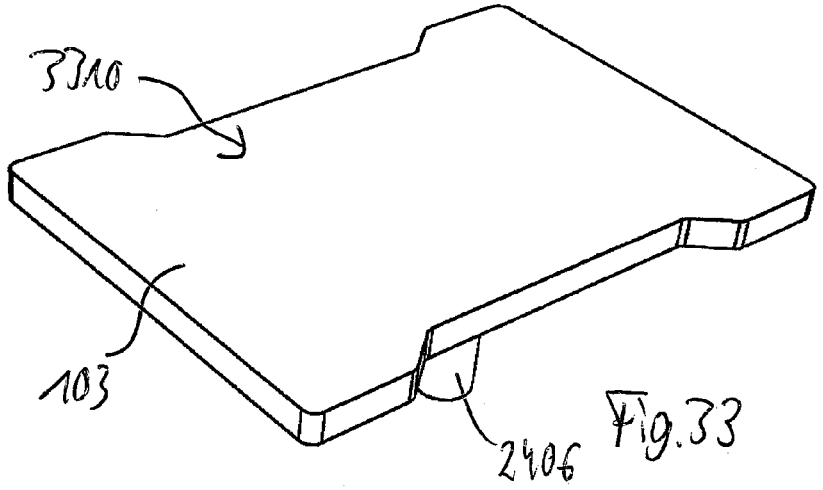
FIG. 33 shows a top view of a base plate for use with the support element of FIG. 31 and FIG. 32 of a sample handling device according to an exemplary embodiment of the invention.

FIG. 33 shows an upper view of the base plate 103 without the corner elements 2502. FIG. 34 shows a bottom view of the base plate 103.

It should be noted that the term "comprising" does not exclude other elements or features and the "a" or "an" does not exclude a plurality. Also elements described in association with different embodiments may be combined.

It should also be noted that reference signs in the claims shall not be construed as limiting the scope of the claims.

The invention claimed is:

1. A sample handling device for handling a sample, the sample handling device comprising:

a drive shaft being drivable by a drive unit;

a base plate mounted to follow a motion of the drive shaft when being driven by the drive unit, wherein the base plate is configured to receive a sample carrier block mountable to follow a motion of the base plate;

a compensation weight mounted on the drive shaft in a manner to at least partially compensate an unbalanced mass of the sample handling device during the motion;

a magnetic guide system adapted for converting an eccentric motion of the drive shaft into an orbital motion of the base plate; and a first guide plate and a second guide plate, wherein the first guide plate and the second guide plate are mounted to remain spatially fixed when the base plate is moving; and wherein the base plate is mounted between the first guide plate and the second guide plate to enable the base plate to move within a plane and to disable the base plate to move out of the plane.

2. The sample handling device of claim 1, further comprising a guide structure, wherein the guide structure is mounted to remain spatially fixed when the base plate is moving;

wherein the base plate is mounted at the guide structure to enable the base plate to move within a plane and to disable the base plate to move out of the plane.

3. The sample handling device of claim 1, comprising at least a first magnetic element arranged on and/or in the base plate;

comprising at least a second magnetic element arranged on and/or in at least one of the first guide plate and the second guide plate;

wherein the at least one first magnetic element and the at least one second magnetic element are configured to cooperate in a manner to convert an eccentric motion of the drive shaft into an orbital motion of the base plate.

4. The sample handling device of claim 1, comprising the sample carrier block mountable on the base plate to follow a motion of the base plate.

5. The sample handling device of claim 4, comprising at least one base plate magnetic element arranged on and/or in the base plate;

comprising at least one sample carrier block magnetic element arranged on and/or in the sample carrier block;

wherein the at least one base plate magnetic element and the at least one sample carrier block magnetic element are configured to cooperate in a manner to fasten the sample carrier block at the base plate by an attracting magnetic force.

6. The sample handling device of claim 4, wherein the sample carrier block comprises a vortex member adapted to provide a vortex function to a user operating the sample handling device.

7. The sample handling device of claim 1, comprising a cover element adapted for covering the sample carrier block.

8. The sample handling device of claim 7, comprising at least one cover magnetic element arranged on and/or in the cover element;

comprising at least one casing magnetic element arranged on and/or in a casing of the sample handling device;

wherein the at least one cover magnetic element and the at least one casing magnetic element are configured to cooperate in a manner to fasten the cover element at the casing by an attracting magnetic force.

9. The sample handling device of claim 8, wherein the at least one cover magnetic element is configured to conduct an electric current to and/or from the cover element.

10. The sample handling device of claim 1, comprising a support element adapted to at least partially accommodate the drive shaft and the drive unit and adapted in such a manner that the base plate is mountable on the support element.

11. The sample handling device of claim 1, wherein the base plate has a rectangular reception area adapted for receiving a rectangular sample carrier block.

12. The sample handling device of claim 11, wherein the base plate comprises a plurality of engagement members, arranged in corners of the base plate, adapted for engaging the rectangular sample carrier block.

13. The sample handling device of claim 1, having exactly one compensation weight, having a center of gravity being arranged at the same vertical level as a center of gravity of the cooperatively moving base plate and sample carrier block.

14. The sample handling device of claim 13, wherein the base plate has a recess in a bearing surface opposing a sample surface portion at which the sample carrier block is mountable, wherein at least a part of the exactly one compensation weight is received within the recess when the base plate is mounted on the support element.

15. A sample handling device for handling a sample, the sample handling device comprising:

a drive shaft being drivable by a drive unit;

a base plate mounted to follow a motion of the drive shaft when being driven by the drive unit, wherein the base plate is configured to receive a sample carrier block mountable to follow a motion of the base plate;

a compensation weight mounted on the drive shaft in a manner to at least partially compensate an unbalanced mass of the sample handling device during the motion; and a magnetic guide system adapted for converting an eccentric motion of the drive shaft into an orbital motion of the base plate; and a support element adapted to at least partially accommodate the drive shaft and the drive unit and adapted in such a manner that the base plate is mountable on the support element;

wherein the support element comprises at least one guide hole and the base plate comprises at least one guide pin configured to correspond to the at least one guide hole so that the base plate is mountable on the support element by inserting the at least one guide pin into the at least one guide hole.

16. The sample handling device of claim 15, wherein the support element comprises a plurality of circularly arranged guide holes and the base plate comprises a plurality of circularly arranged guide pins configured to correspond to the plurality of guide holes.

17. The sample handling device of claim 15, comprising a magnetic element arranged in an interior of the at least one guide hole and comprising a magnetic element provided on the at least one guide pin.

18. A sample handling device for handling a sample, the sample handling device comprising:

a drive shaft being drivable by a drive unit;

a base plate mounted to follow a motion of the drive shaft when being driven by the drive unit, wherein the base plate is configured to receive a sample carrier block mountable to follow a motion of the base plate;

a compensation weight mounted on the drive shaft in a manner to at least partially compensate an unbalanced mass of the sample handling device during the motion; and a magnetic guide system adapted for converting an eccentric motion of the drive shaft into an orbital motion of the base plate; and a support element adapted to at least partially accommodate the drive shaft and the drive unit and adapted in such a manner that the base plate is mountable on the support element;

wherein the support element comprises at least one first bearing hole, the base plate comprises at least one second bearing hole configured to correspond to the at least one first bearing hole, wherein the sample handling device comprises at least one ball arranged partially within the at least one first bearing hole and partially within the at least one second bearing hole to thereby form a ball bearing between the support element and the base plate.

19. The sample handling device of claim 18, wherein the support element comprises a plurality of circularly arranged first bearing holes and the base plate comprises a plurality of circularly arranged second bearing holes configured to correspond to the plurality of first bearing holes, and wherein the sample handling device comprises a plurality of balls.

20. The sample handling device of claim 18, comprising a magnetic element arranged in an interior of the at least one first bearing hole and comprising a magnetic element arranged in an interior of the at least one second bearing hole.

21. A sample handling device for handling a sample, the sample handling device comprising:

a drive shaft being drivable by a drive unit;

a base plate mounted to follow a motion of the drive shaft when being driven by the drive unit, wherein the base plate is configured to receive a sample carrier block mountable to follow a motion of the base plate;

a compensation weight mounted on the drive shaft in a manner to at least partially compensate an unbalanced mass of the sample handling device during the motion; and a magnetic guide system adapted for converting an eccentric motion of the drive shaft into an orbital motion of the base plate;

a support element adapted to at least partially accommodate the drive shaft and the drive unit and adapted in such a manner that the base plate is mountable on the support element; and at least one centering plunger arranged in a movable manner within the support element and being adapted to be moved to project out of the support element and to abut against a lower surface of the base plate to thereby drive back the base plate to a central position.

22. The sample handling device of claim 21, wherein the at least one centering plunger is adapted to be moved to project out of the support element upon switching off the drive unit.

23. A sample handling device for handling a sample, the sample handling device comprising:

a drive shaft being drivable by a drive unit;

a base plate mounted to follow a motion of the drive shaft when being driven by the drive unit, wherein the base plate is configured to receive a sample carrier block mountable to follow a motion of the base plate;

a compensation weight mounted on the drive shaft in a manner to at least partially compensate an unbalanced mass of the sample handling device during the motion; and a magnetic guide system adapted for converting an eccentric motion of the drive shaft into an orbital motion of the base plate;

a support element adapted to at least partially accommodate the drive shaft and the drive unit and adapted in such a manner that the base plate is mountable on the support element; and at least one centering plunger arranged in a movable manner within the support element and being adapted to be moved to project out of the support element and to abut against a lower surface of the base plate to thereby drive back the base plate to a central position; and at least one centering hole arranged in the lower surface of the base plate corresponding to the at least one centering plunger to be engageable by the at least one centering plunger when being moved to project out of the support element.

24. A method of handling a sample, the method comprising mounting the sample on a sample carrier block of the sample handling device of claim 1;

mounting the sample carrier block on a base plate of the sample handling device, wherein the base plate is mounted to follow a motion of a drive shaft being drivable by a drive unit of the sample handling device;

driving the drive shaft by the drive unit;

at least partially compensating an unbalanced mass of the sample handling device during the motion by a compensation weight mounted on the drive shaft; and converting an eccentric motion of the drive shaft into an orbital motion of the base plate by a magnetic guide system.

25. A sample handling device for handling a sample, the sample handling device comprising a drive shaft being drivable by a drive unit; a base plate mounted to follow a motion of the drive shaft when being driven by the drive unit, wherein the base plate is configured to receive a sample carrier block mountable to follow a motion of the base plate; a compensation weight mounted on the drive shaft in a manner to at least partially compensate an unbalanced mass of the sample handling device during the motion; a magnetic guide system adapted for converting an eccentric motion of the drive shaft into an orbital motion of the base plate; and a first guide plate and a second guide plate, wherein the first guide plate and the second guide plate are mounted to remain spatially fixed when the base plate is moving; and wherein the base plate is mounted between the first guide plate and the second guide plate to enable the base plate to move within a plane and to disable the base plate to move out of the plane; a mountable sample carrier block; a plurality of sample reception units arranged on and/or in the sample carrier block and each being adapted for receiving a respective sample container; a sample temperature manipulation unit integrated in the sample carrier block and adapted for manipulating a temperature of each of the plurality of sample reception units, wherein the sample temperature manipulation unit is arranged symmetrically with respect to at least a part of the plurality of sample reception units; wherein the sample carrier block comprises a central recess formed in a lower surface of the sample carrier block, the central recess being adapted for receiving the sample temperature manipulation unit to be inserted from the lower surface, the central recess having the same distance from at least the part of the plurality of sample reception units.

26. The sample handling device of claim 25, wherein the plurality of sample reception units are arranged in the sample carrier block in a rotationally symmetrically manner.

27. The sample handling device of claim 25, wherein at least a part of the plurality of sample reception units are arranged in the sample carrier block at the same distance from the sample temperature manipulation unit.

28. The sample handling device of claim 25, wherein the sample carrier block is cylindrical.

29. The sample handling device of claim 25, wherein the sample temperature manipulation unit is arranged thermodynamically symmetrically and/or geometrically symmetrically with respect to at least a part of the plurality of sample reception units.

30. A method of handling a sample, the method comprising: providing the sample handling device of claim 1, mounting a sample carrier block into said sample handling device; inserting a plurality of sample containers in a plurality of sample reception units arranged on and/or in the sample carrier block; manipulating a temperature of each of the plurality of sample reception units by a sample temperature manipulation unit integrated in the sample carrier block and arranged symmetrically with respect to at least a part of the plurality of sample reception units; wherein the sample carrier block comprises a central recess formed in a lower surface of the sample carrier block, the central recess being adapted for receiving the sample temperature manipulation unit to be inserted from the lower surface, the central recess having the same distance from at least the part of the plurality of sample reception units.

31. A sample handling device for handling a sample, the sample handling device comprising:

a drive shaft being drivable by a drive unit;

a base plate mounted to follow a motion of the drive shaft when being driven by the drive unit, wherein the base plate is configured to receive a sample carrier block mountable to follow a motion of the base plate;

a compensation weight mounted on the drive shaft in a manner to at least partially compensate an unbalanced mass of the sample handling device during the motion;

a magnetic guide system adapted for converting an eccentric motion of the drive shaft into an orbital motion of the base plate; and a sandwich bearing which comprises a first guide plate, a first bearing, the base plate, a second bearing, and a second guide plate;

wherein the only movable element in the sandwich bearing is the base plate;

wherein the base plate is arranged between the first bearing and the second bearing;

wherein the first bearing is arranged between the first guide plate and the base plate;

wherein the second bearing is arranged between the second guide plate and the base plate;

wherein each of the first guide plate, the base plate, and the second guide plate comprises magnetic elements;

wherein the magnetic elements of the first guide plate and the magnetic elements of the base plate are adapted to attract one another; and wherein the magnetic elements of the second guide plate and the magnetic elements of the base plate are adapted to attract one another.

* * * * *